US010819071B2

(12) United States Patent
Maesoba et al.

(10) Patent No.: US 10,819,071 B2
(45) Date of Patent: Oct. 27, 2020

(54) CONNECTOR STRUCTURE THAT IS RECONFIGURABLE TO ACCOMMODATE EITHER AN STP CABLE OR A UTP CABLE

(71) Applicants: AutoNetworks Technologies, Ltd., Yokkaichi-shi, Mie (JP); Sumitomo Wiring Systems, Ltd., Yokkaichi-shi, Mie (JP); SUMITOMO ELECTRIC INDUSTRIES, LTD., Osaka-shi, Osaka (JP); Toyota Jidosha Kabushiki Kaisha, Toyota-shi, Aichi (JP)

(72) Inventors: Hiroyoshi Maesoba, Yokkaichi (JP); Toshifumi Ichio, Yokkaichi (JP); Kimiyasu Okumura, Yokkaichi (JP); Hiroshi Kobayashi, Okazaki (JP); Motoya Hara, Nisshin (JP); Ryutaro Yamazaki, Toyota (JP)

( * ) Notice: Subject to any disclaimer, the term of this patent is extended or adjusted under 35 U.S.C. 154(b) by 0 days.

(21) Appl. No.: 16/340,733

(22) PCT Filed: Sep. 21, 2017

(86) PCT No.: PCT/JP2017/034006
§ 371 (c)(1),
(2) Date: Apr. 10, 2019

(87) PCT Pub. No.: WO2018/070204
PCT Pub. Date: Apr. 19, 2018

(65) Prior Publication Data

US 2019/0319406 A1 Oct. 17, 2019

(30) Foreign Application Priority Data

Oct. 12, 2016 (JP) ..... 2016-200515

(51) Int. Cl.
*H01R 13/6463* (2011.01)
*H01R 13/6474* (2011.01)
*H01R 24/60* (2011.01)

(52) U.S. Cl.
CPC ..... *H01R 13/6463* (2013.01); *H01R 13/6474* (2013.01); *H01R 24/60* (2013.01)

(58) Field of Classification Search
CPC . H01R 13/6463; H01R 13/6474; H01R 24/60
See application file for complete search history.

(56) References Cited

U.S. PATENT DOCUMENTS 6,280,209 B1 8/2001 Bassler et al.
6,457,983 B1 10/2002 Bassler et al.
(Continued)

FOREIGN PATENT DOCUMENTS

JP 2009-135122 6/2009
JP 2012-195315 10/2012
(Continued)

OTHER PUBLICATIONS

International Search Report.

*Primary Examiner* — Tho D Ta

(57) ABSTRACT

A connector is capable of replacing an STP cable (10B) and a UTP cable (10A) without a large structural change. UTP connection terminals (21A) are accommodated in accommodating portions (26) of a UTP dielectric (22A) that are close to each other in a width direction. Thus, elastic contact pieces (32) thereof are located inside and close to each other in the width direction, while receiving portions (31) are located outside and spaced from each other in the width direction. STP connection terminals (21B) are accommodated in accommodating portions (26) of an STP dielectric (22B) that are spaced more apart in the width direction than those of the UTP dielectric (22A). Thus, elastic contact pieces (32) thereof are located outside and are spaced from
(Continued)

each other in the width direction, while receiving portions (31) thereof are located inside so as to be close to each other in the width direction.

1 Claim, 27 Drawing Sheets

(56) References Cited

U.S. PATENT DOCUMENTS

| | | | | |
|---|---|---|---|---|
| 7,909,647 | B2 * | 3/2011 | Kawaguchi | H01R 9/035 439/585 |
| 9,502,158 | B2 * | 11/2016 | Bes | H01R 13/4361 |
| 10,103,500 | B2 * | 10/2018 | Zebhauser | H01R 4/20 |
| 2011/0136391 | A1 | 6/2011 | Kameyama | |
| 2015/0200486 | A1 | 7/2015 | Yagi et al. | |
| 2015/0222040 | A1 | 8/2015 | Endo et al. | |
| 2017/0352989 | A1 | 12/2017 | Takahashi | |

FOREIGN PATENT DOCUMENTS

| | | |
|---|---|---|
| JP | 5087487 | 12/2012 |
| JP | 5333632 | 11/2013 |
| JP | 2015-53194 | 3/2015 |
| JP | 2015-149189 | 8/2015 |
| JP | 2016-39046 | 3/2016 |
| JP | 2016-115625 | 6/2018 |
| WO | 2016/132855 | 8/2016 |

* cited by examiner

CONNECTOR STRUCTURE THAT IS RECONFIGURABLE TO ACCOMMODATE EITHER AN STP CABLE OR A UTP CABLE

BACKGROUND

Field of the Invention

The present invention relates to a connector structure.

Conventionally, a twisted pair cable in which electric wires are twisted together is less susceptible to noise than a simple parallel line and has less noise radiation, so that the twisted pair cable is suitably used for an in-vehicle network or the like. As the twisted pair cables, an STP (shielded twisted pair) cable and a UTP (unshielded twisted pair) cable are known. Among them, in the STP cable, the electric wires are surrounded by a shield conductor, so that the STP cable has stronger resistance to noise.

Related Art

For example, Japanese Patent No. 5333632 discloses a connector including an inner conductor terminal connected to an end portion of an STP cable, an inner housing (dielectric) accommodating the inner conductor terminal, a shield shell connected to a shield conductor of the STP cable and surrounding the inner housing, and an outer housing accommodating the shield shell.

On the other hand, Japanese Patent No. 5087487 discloses a connector including a connection terminal connected to an end portion of a UTP cable and a connector body (dielectric) having a terminal accommodating portion which accommodates the connection terminal.

The connectors of Japanese Patent No. 5333632 and Japanese Patent No. 50874872 include a common configuration that each electric wire of the UTP cable and the STP cable is connected to a terminal and the terminal is accommodated in the dielectric. In this case, if the STP cable can be replaced with the UTP cable or if the UTP cable can be replaced with the STP cable while making use of a common structural portion in the connectors, mold design becomes easy, and the cost can be reduced. However, there is a circumstance that in principle there is no compatibility between the UTP cable and the STP cable, and each impedance is different.

The present invention has been completed based on the above circumstances, and its purpose is to provide a connector structure capable of replacing an STP cable and a UTP cable without making a large structural change.

SUMMARY

A connector structure of the present invention includes a UTP connection terminal which is connected to each electric wire of a UTP cable and has a box portion to which a male terminal is inserted and connected, an STP connection terminal which is connected to each electric wire of an STP cable and has a box portion to which a male terminal is inserted and connected, a UTP dielectric which has an accommodating portion in which the UTP connection terminal is accommodated, and an STP dielectric which has an accommodating portion in which the STP connection terminal is accommodated. In this connector structure, a receiving portion and an elastic contact piece facing the receiving portion are arranged in each of the box portions of the UTP connection terminal and the STP connection terminal, the elastic contact piece protrudes inside the box portion with a protruding amount larger than that of the receiving portion, and the male terminal is held between the receiving portion and the elastic contact piece. In each of the UTP dielectric and the STP dielectric, the accommodating portions are arranged in pairs in a width direction perpendicular to an insertion direction of the male terminal, and a widthwise clearance of the pair of accommodating portions is shorter in the UTP dielectric than in the STP dielectric. The UTP connection terminals are accommodated in the pair of accommodating portions of the UTP dielectric such that the elastic contact pieces thereof are located inside so as to be close to each other in the width direction and the receiving portions thereof are located outside so as to be spaced apart from each other in the width direction, and the STP connection terminals are accommodated in the pair of accommodating portions of the STP dielectric such that the elastic contacts piece thereof are located outside so as to be spaced apart from each other in the width direction and the receiving portions thereof are located inside so as to be close to each other in the width direction.

Since the accommodating portions in pairs of the UTP dielectric are closer to each other in the width direction than those of the STP dielectric, when the UTP connection terminals connected to respective electric wires of the UTP cable are accommodated in the pair of accommodating portions of the UTP dielectric, the impedance can be reduced. On the other hand, since the accommodating portions in pairs of the STP dielectric are spaced more apart from each other in the width direction than those of the UTP dielectric, when the STP connection terminals connected to respective electric wires of the STP cable are accommodated in the pair of accommodating portions of the STP dielectric, the impedance can be increased. As a result, it is possible to suitably adjust the impedance between the UTP cable side and the STP cable side. In adjusting the impedance, there is no need to change basic structures of the UTP connection terminal and the STP connection terminal, and, in addition, when a positional relation between the elastic contact piece and the receiving portion is reversed between the UTP connection terminal and the STP connection terminal, a widthwise clearance (pitch width) between the male terminals to be connected to the UTP connection terminals and a widthwise clearance (pitch width) between the male terminals to be connected to the STP connection terminals can be identical to the same pitch width. Accordingly, it is not necessary to make a large structural change as a whole, and thus it is possible to easily replace the UTP cable and the STP cable.

The box portion of the UTP connection terminal has the same shape as the box portion of the STP connection terminal. According to this constitution, the box portion of each terminal can be manufactured with the same mold, with the result that the manufacturing cost can be reduced.

DETAILED DESCRIPTION

An embodiment of the invention will be described with reference to the drawings. A connector structure of this embodiment is used for an in-vehicle communication network system and includes a UTP connector 20A provided at an end portion of a UTP cable 10A and an STP connector 20B provided at an end portion of an STP cable 10B, and one of the connectors 20A and 20B can be selectively used. The UTP connector 20A and the STP connector 20B have a structural portion in common or approximate to each other, and it is possible to replace the UTP cable 10A and the STP cable 10B while adjusting impedance.

Figure 1:
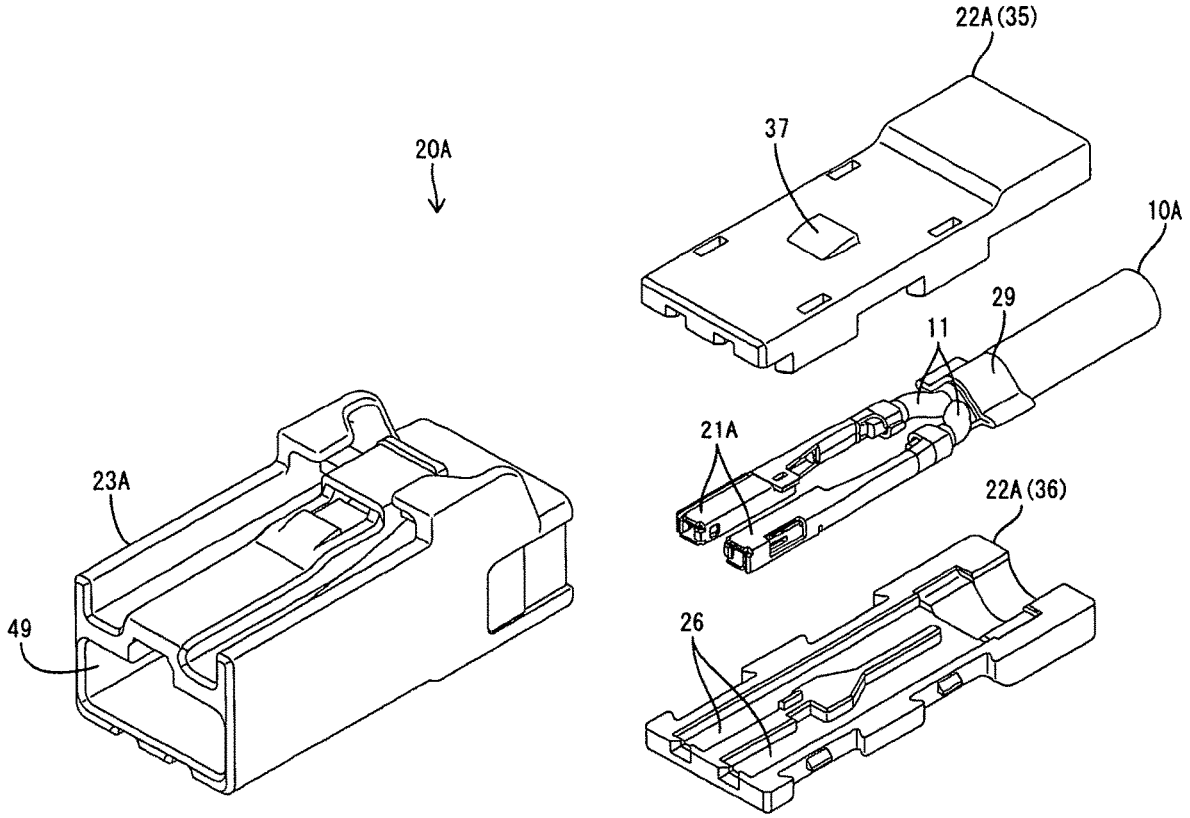
FIG. 1 is an exploded perspective view of an UTP connector of Embodiment 1 of the present invention.
Figure 13:
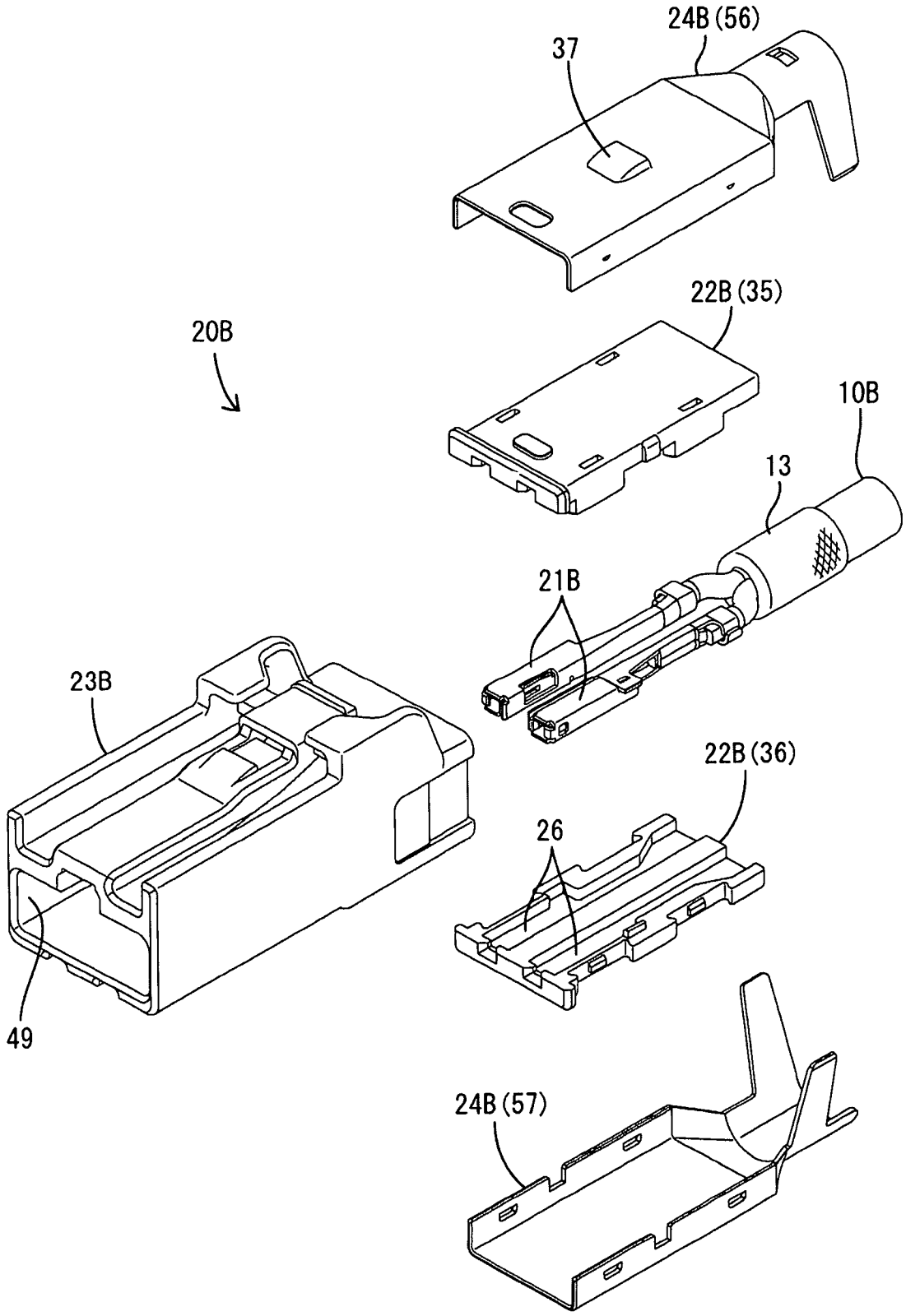
FIG. 13 is an exploded perspective view of an STP connector.

The UTP connector 20A is fitted to a mating UTP connector 90A and, as shown in FIG. 1, includes a UTP connection terminal 21A, a UTP dielectric 22A, and a UTP housing 23A. The STP connector 20B is fitted to a mating STP connector 90B and, as shown in FIG. 13, includes an STP connection terminal 21B, an STP dielectric 22B, an outer conductor 24B, and an STP housing 23B.

[UTP Cable]

Figure 2:
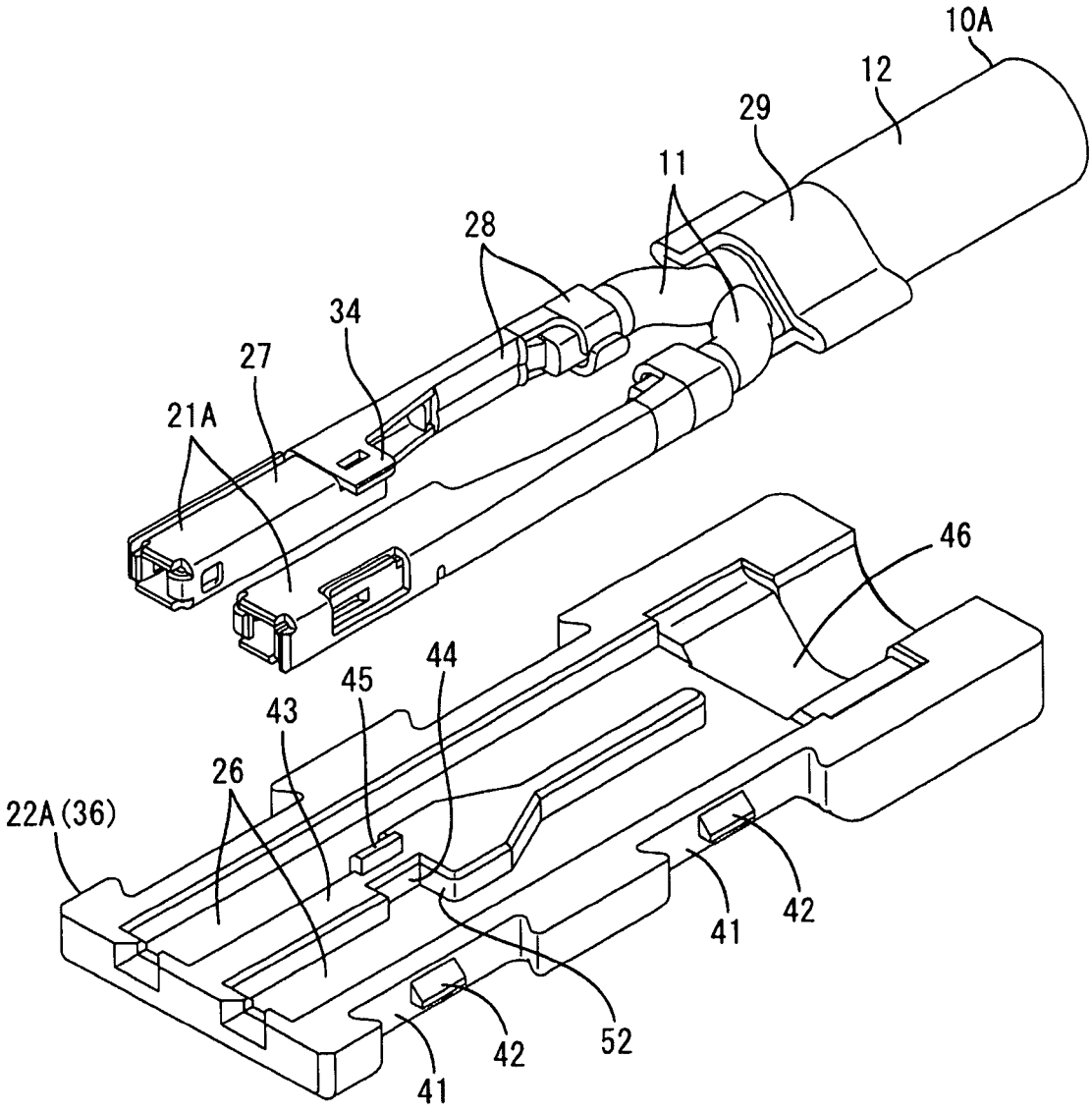
FIG. 2 is an exploded perspective view showing UTP connection terminals and a lower dielectric.

As shown in FIG. 2, the UTP cable 10A is constituted of a pair of twisted electric wires 11 and a sheath 12 surrounding the electric wires 11. The electric wire 11 is constituted of a conductor portion and a covering portion surrounding the conductor portion. The respective end portions of the electric wires 11 are exposed from the sheath 12 and connected to the UTP connection terminals 21A respectively.

[UTP Connection Terminal]

The UTP connection terminals 21A connected to the electric wires 11 of the UTP cable 10A are constructed in the same shape. When the UTP connector 20A is fitted with the mating UTP connector 90A, each UTP connection terminal 21A is electrically connected to a male terminal 91 provided in a mating UTP connector 90A. The UTP connection terminal 21A is integrally formed by, for example, bending a conductive metal plate material and has an elongated shape as a whole in the front-rear direction (horizontal direction in FIG. 9).

Figure 9:
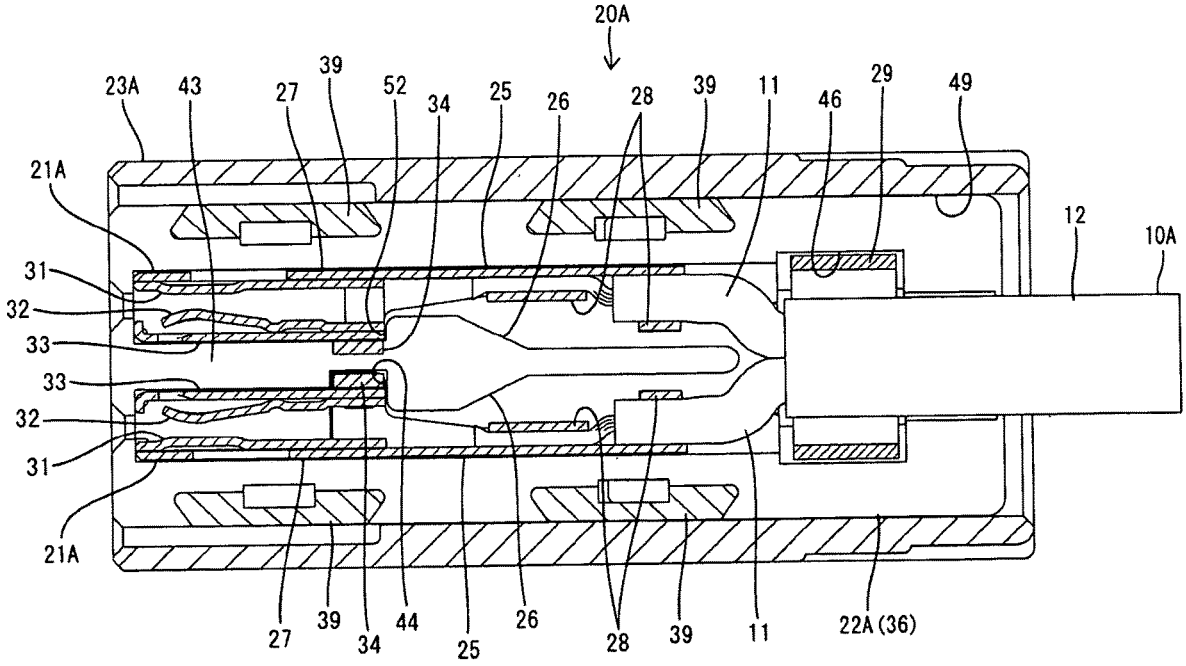
FIG. 9 is a cross-sectional view of the UTP connector in a plan view direction.

As shown in FIG. 9, the UTP connection terminal 21A has a band plate-shaped base plate portion 25 extending in the front-rear direction. A box portion 27 having a substantially rectangular tubular shape is provided at a front end portion of the base plate portion 25, and an open barrel-shaped barrel portion 28 is provided at a rear end portion of the base plate portion 25. The barrel portion 28 is electrically and mechanically connected to the conductor portion and the covering portion of the electric wire 11, respectively. A swaging ring 29 separate from the UTP connection terminal 21A is crimped and connected to an end portion of the sheath 12 of the UTP cable 10A.

In the interior of the box portion 27, a receiving portion 31 and an elastic contact piece 32 protrude so as to face each other in the width direction.

In the UTP connection terminal 21A, the receiving portion 31 having a trapezoidal cross section is fixedly provided on the base plate portion 25 side, and the band plate-shaped elastic contact piece 32 is protrudingly provided on a top plate portion 33 side opposite to the base plate portion 25. The elastic contact piece 32 is formed to extend forward from the rear end side of the top plate portion 33 in a cantilever fashion, and is flexibly deformable with the rear end side of the top plate portion 33 as a fulcrum.

Figure 11:
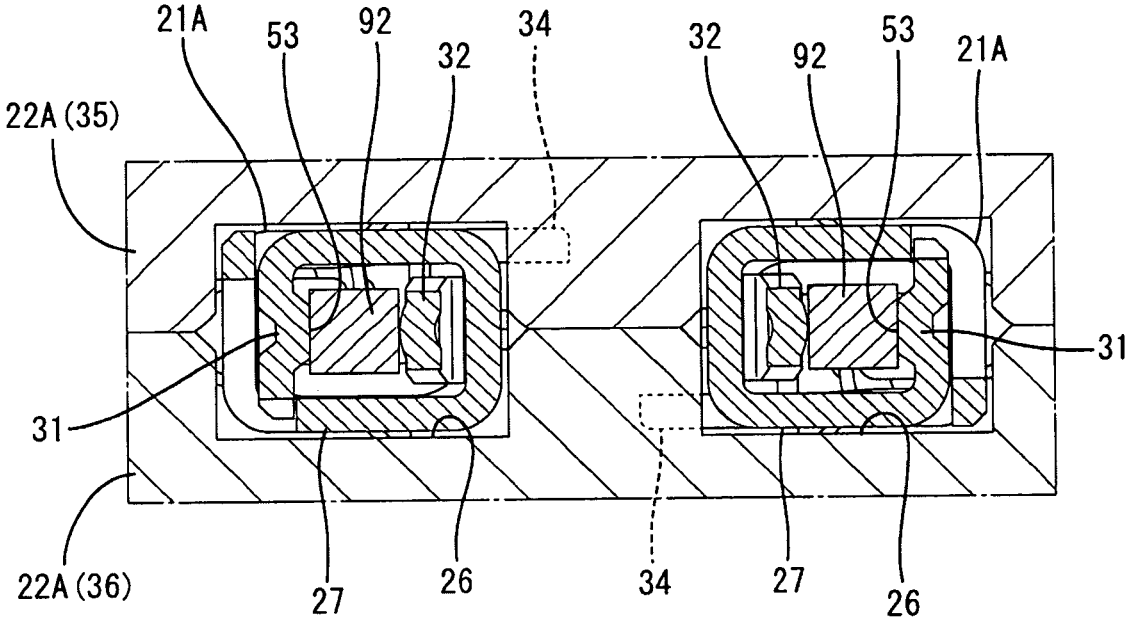
FIG. 11 is a front cross-sectional view showing the UTP connection terminals and male terminals in a connected state.

The amount of protrusion into the box portion 27 (dimension in the vertical direction in FIG. 9) is larger in the elastic contact piece 32 than in the receiving portion 31. Thus, a top portion of the elastic contact piece 32 is located closer to the center of the box portion 27 than an end surface of the receiving portion 31. When the UTP connection terminal 21A is connected to the male terminal 91, a tab portion 92 of the male terminal 91 described later is inserted into the box portion 27, and the inserted tab portion 92 is elastically held between the receiving portion 31 and the elastic contact piece 32 to be conductively connected. As shown in FIG. 11, the box portion 27 has an insertion region 53 for the male terminal 91 between the receiving portion 31 and the elastic contact piece 32. The UTP connection terminal 21A has a protruding portion 34 protruding from one end side of the top plate portion 33 in a direction perpendicular to a planar direction of the top plate portion 33.

[UTP Dielectric]

Figure 4:
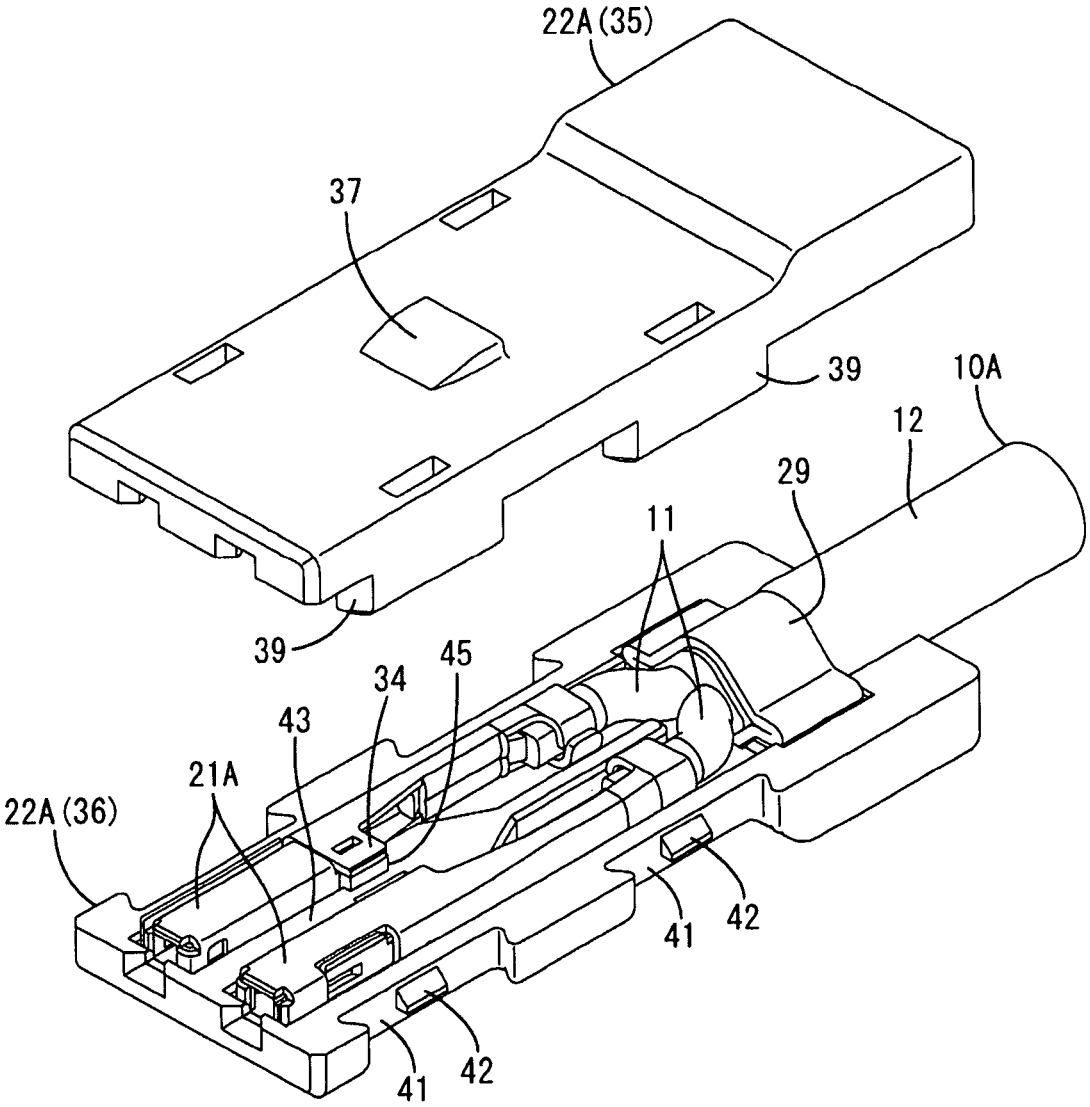
FIG. 4 is an exploded perspective view showing the lower dielectric in which the UTP connection terminals are accommodated and an upper dielectric.

The UTP dielectric 22A is made of a synthetic resin and is constituted of an upper dielectric 35 and a lower dielectric 36 that can be split vertically. As shown in FIG. 4, the upper dielectric 35 has a substantially rectangular plate shape in a plan view and has a locking protrusion 37, which can be locked to the UTP housing 23A, at the widthwise center of the upper surface. The lower surface of the upper dielectric 35 is provided with a recess 38 (see FIG. 8) which positions upper portions of the UTP connection terminals 21A in a parallel state and positions an upper portion of the swaging ring 29. Both widthwise end portions of the upper dielectric 35 are provided with a pair of front and rear attachment pieces 39 protruding downward.

As shown in FIG. 2, the lower dielectric 36 has a substantially rectangular plate shape in a plan view, has a pair of front and rear attachment receiving portions 41 each having a rectangular recessed shape at both widthwise end portions, and has attachment protrusions 42 each provided on an inner surface of each attachment receiving portion 41. Each attachment piece 39 is fitted to each attachment receiving portion 41, and a distal end portion of the attachment piece 39 is hooked and locked to the attachment protrusion 42, whereby the lower dielectric 36 and the upper dielectric 35 are held in a combined state while the UTP connection terminals 21A are sandwiched therebetween.

Figure 5:
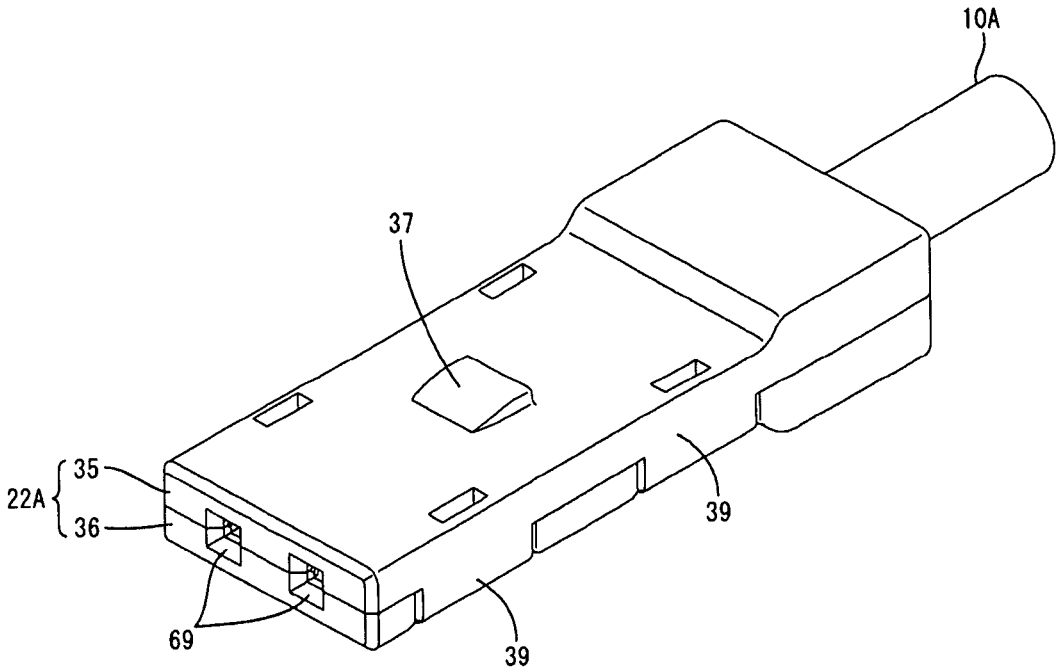
FIG. 5 is a perspective view of a UTP dielectric in which the lower dielectric and the upper dielectric are held in a combined state.

The upper surface of the lower dielectric 36 has accommodating portions 26 which accommodate lower portions of the UTP connection terminals 21A in a parallel state. The accommodating portions 26 each have a cross-sectional shape corresponding to the outer shape of the UTP connection terminal 21A, and are provided in pairs on both sides in the width direction width direction with the partition wall 43 sandwiched therebetween. As shown in FIG. 5, when the lower dielectric 36 and the upper dielectric 35 are in a combined state, tab insertion holes 69 through which the tab portions 92 can be inserted in communication with the accommodating portions 26 are provided as openings on a front surface of the UTP dielectric 22A.

One of the accommodating portions 26 (the upper side in FIG. 2) has a plate piece-like protruding piece portion 45 protruding upward from a side edge of the partition wall 43, and the other accommodating portion 26 (the lower side in FIG. 2) has a recess 44 formed by recessing the partition wall 43 in a cross-sectionally rectangular shape. The partition wall 43 has a step portion 52 having a stepped shape at a position adjacent to the protruding piece portion 45 and the recess 44.

As shown in FIG. 9, each UTP connection terminal 21A is disposed such that the base plate portion 25 is disposed along a widthwise outer side surface of the accommodating portion 26 (an inner surface of an outer side wall facing the partition wall 43) and a rear end of the box portion 27 on the top plate portion 33 side is disposed along the step portion 52, so that the UTP connection terminals 21A are disposed in a belly-to-belly fashion. The protruding portion 34 of the UTP connection terminal 21A accommodated in one of the accommodating portions 26 is placed and supported on the protruding piece portion 45, and the protruding portion 34 of the UTP connection terminal 21A accommodated in the other accommodating portion 26 is inserted into the recess 44. In the lower surface of the lower dielectric 36, a recessed portion 46 which positions and holds a lower portion of the swaging ring 29 is provided so as to be contiguous with a rear portion of the accommodating portions 26.

[UTP Housing]

Figure 6:
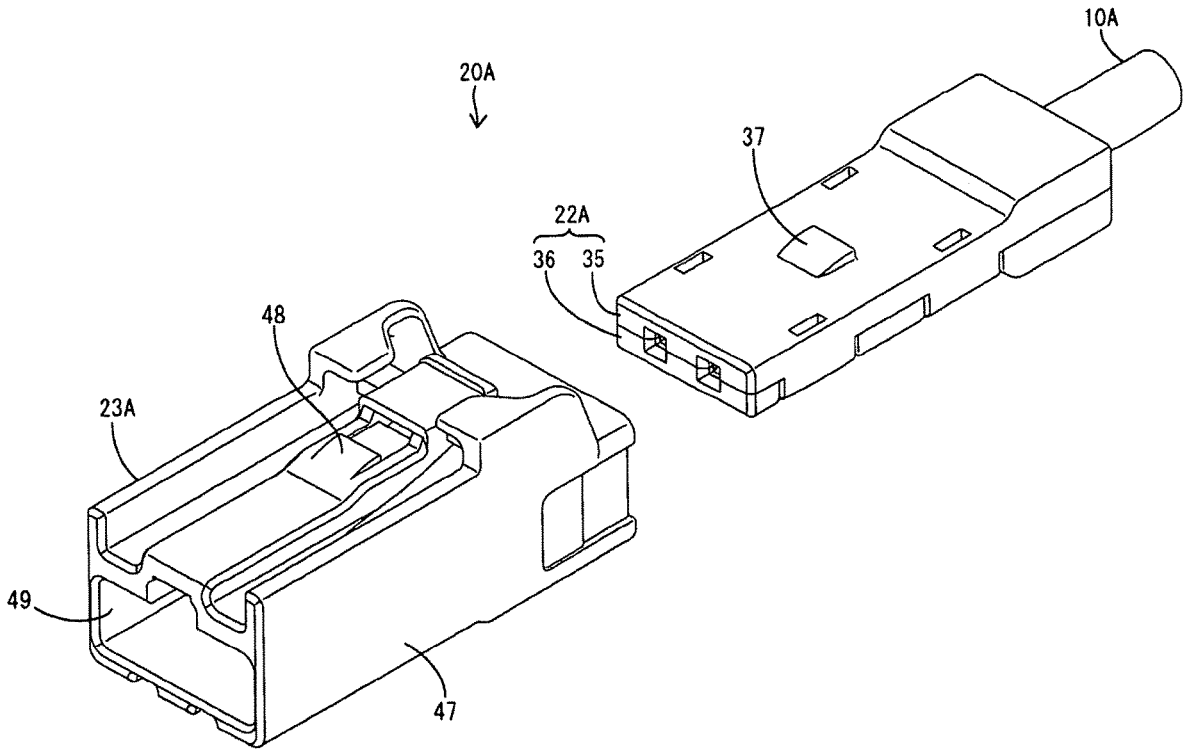
FIG. 6 is an exploded perspective view showing the UTP dielectric and a UTP housing.
Figure 8:
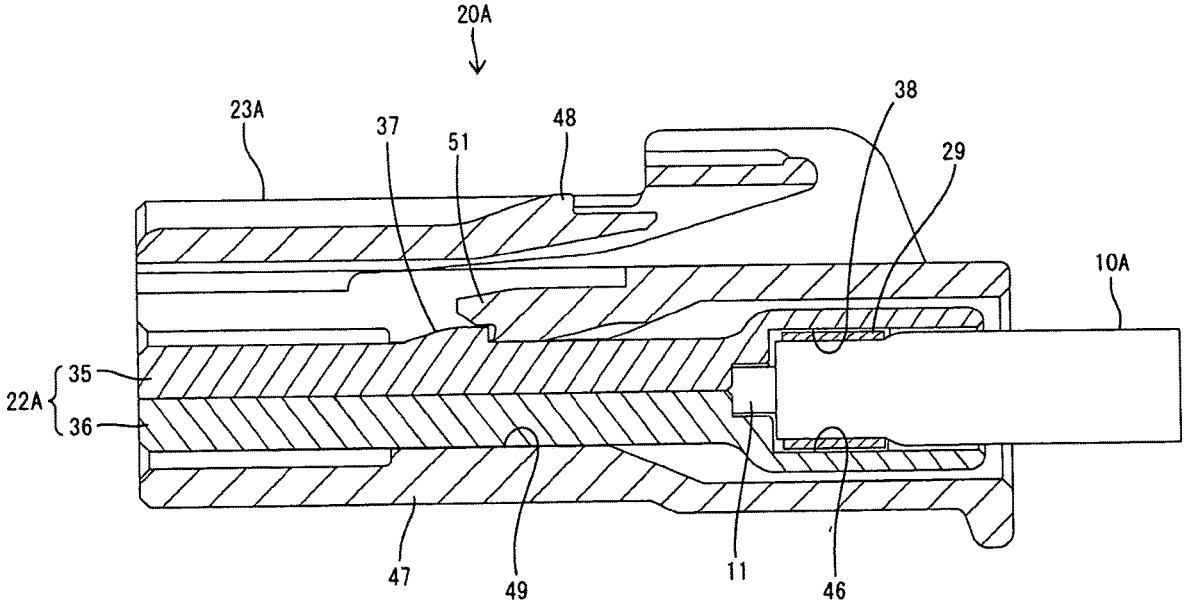
FIG. 8 is a cross-sectional view of the UTP connector in a side view direction.

The UTP housing 23A is made of a synthetic resin and, as shown in FIG. 6, has a substantially rectangular tubular housing body 47. On the upper surface of the housing body 47, a lock arm 48 is protrudingly provided in the central portion in the width direction. The lock arm 48 is formed to extend rearward from an upper front end portion of the housing body 47 in a cantilever fashion, and configured to elastically lock a lock receiving portion 93 of the mating UTP connector 90A and thereby hold the UTP connector 20A and the mating UTP connector 90A in a fitted state. Inside the housing body 47, an insertion portion 49 is provided so as to be opened in the front-rear direction. As shown in FIG. 8, the UTP dielectric 22A can be fitted into the insertion portion 49. The upper surface of the inner wall of the insertion portion 49 is provided with a lance 51 protruding forward in a cantilever fashion. The UTP dielectric 22A is inserted into the insertion portion 49 from behind, the lance 51 is then flexibly deformed by the locking protrusion 37, and thereafter the lance 51 returns and elastically locks the locking protrusion 37, whereby the UTP dielectric 22A is held in the UTP housing 23A.

[Mating UTP Connector]

Figure 12:
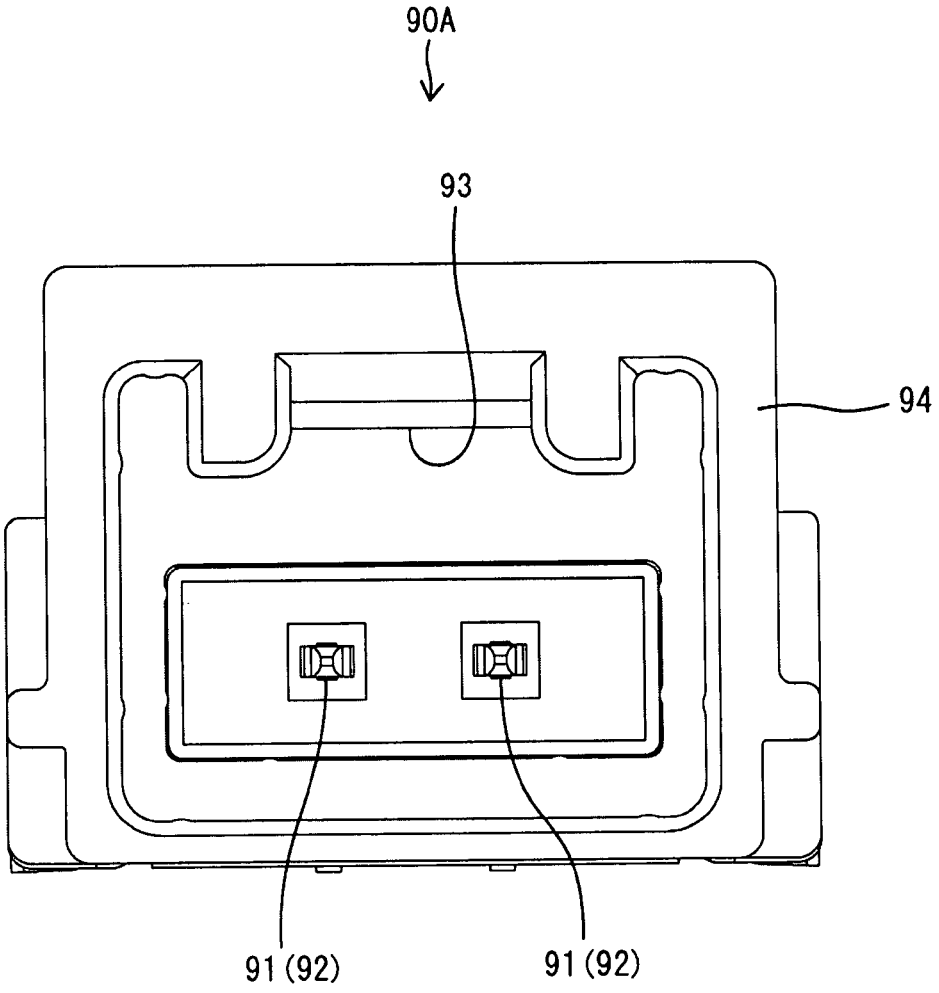
FIG. 12 is a front view of the mating UTP connector.

As shown in FIG. 12, the mating UTP connector 90A has a hood portion 94 made of a synthetic resin. The UTP housing 23A can be fitted into the hood portion 94, and the hood portion 94 is supported on a printed circuit board (not shown). On the inner surface of the upper wall of the hood portion 94, the lock receiving portion 93 to be locked to the lock arm 48 is protrudingly provided.

Figure 10:
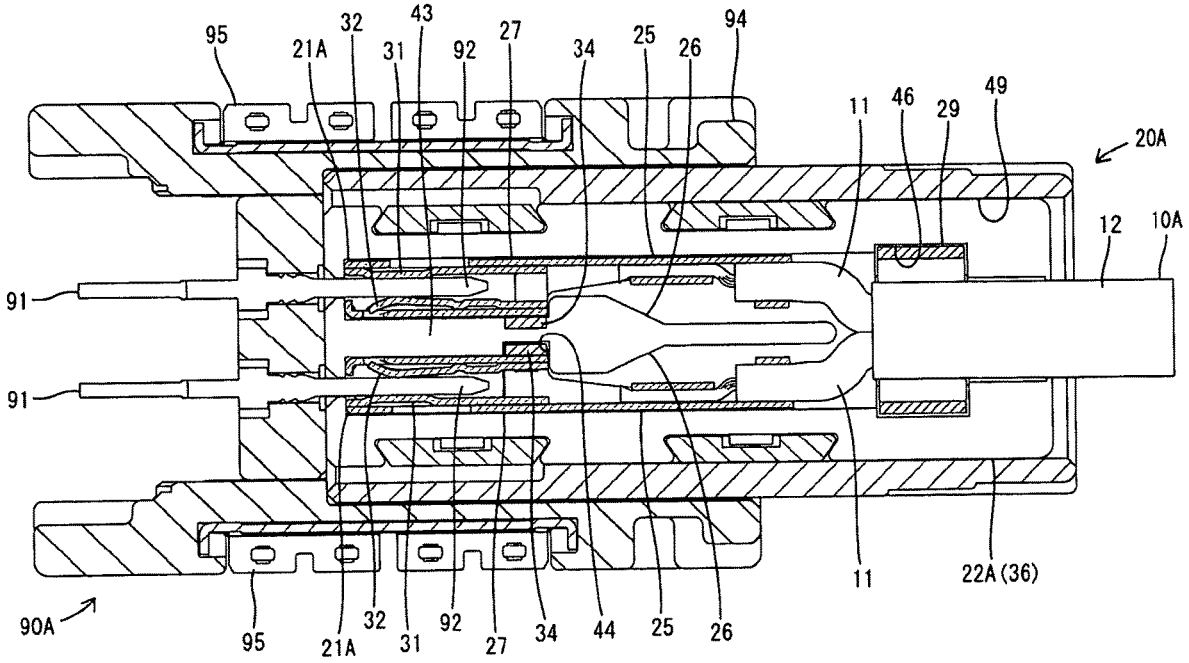
FIG. 10 is a planar cross-sectional view showing the UTP connector and a mating UTP connector in a fitted state.

As shown in FIG. 10, pegs 95 each formed of a metal plate material are attached to outer surfaces of both side walls of the hood portion 94. The peg 95 are soldered to a surface of the circuit board, whereby the mating UTP connector 90A is fixed to the circuit board via the pegs 95.

A pair of the male terminals 91 is attached to the hood portion 94 in the width direction. Each of the male terminals 91 has a square linear shape (square pin shape) as a whole and is bent at a substantially right angle in the middle of the length direction. Each of the male terminals 91 has the tab portion 92 protruding into the hood portion 94. The tab portions 92 of the male terminals 91 are arranged in parallel with a pitch width corresponding to a widthwise clearance (hereinafter referred to as a pitch width) between the insertion regions 53 of the UTP connection terminals 21A accommodated in the accommodating portions 26. Each male terminal 91 has a portion protruding to the outside of the hood portion 94, and this portion is mounted and connected on the surface of the circuit board (not shown) by soldering.

[STP Cable]

Figure 14:
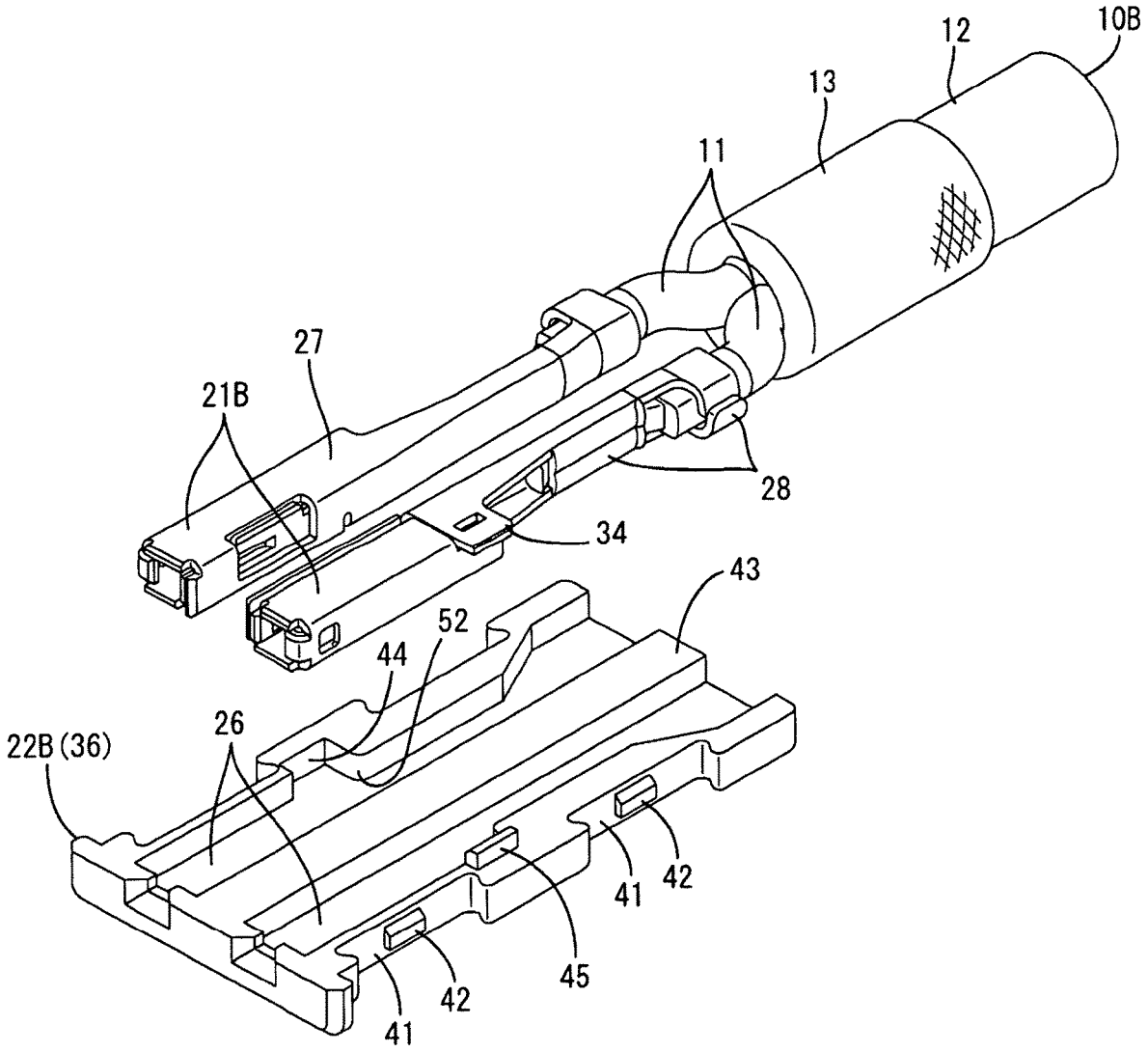
FIG. 14 is an exploded perspective view showing STP connection terminals and a lower dielectric.

As shown in FIG. 14, the STP cable 10B includes the pair of twisted electric wires 11, a shield conductor 13 such as a braided wire which surrounds and shields the electric wires 11, and the sheath 12 which surrounds the shield conductor 13. An end portion of each of the electric wires 11 and an end portion of the shield conductor 13 are exposed from the sheath 12, and the end portion of the shield conductor 13 is folded back and attached to the outer circumference side of the sheath 12. The respective end portions of the electric wires 11 are connected to the STP connection terminals 21B respectively.

[STP Connection Terminal]

The STP connection terminals 21B connected to the electric wires 11 of the STP cable 10B are constructed in the same shape. When the STP connector 20B is fitted with the mating STP connector 90B, each STP connection terminal 21B is connected to a male terminal 91 provided in a mating STP connector 90B. The STP connection terminal 21B has substantially the same shape as the UTP connection terminal 21A, and has the box portion 27 and the barrel portion 28, and includes the receiving portion 31, the elastic contact piece 32 and the protruding portion 34 in the box portion 27.

[STP Dielectric]

Figure 15:
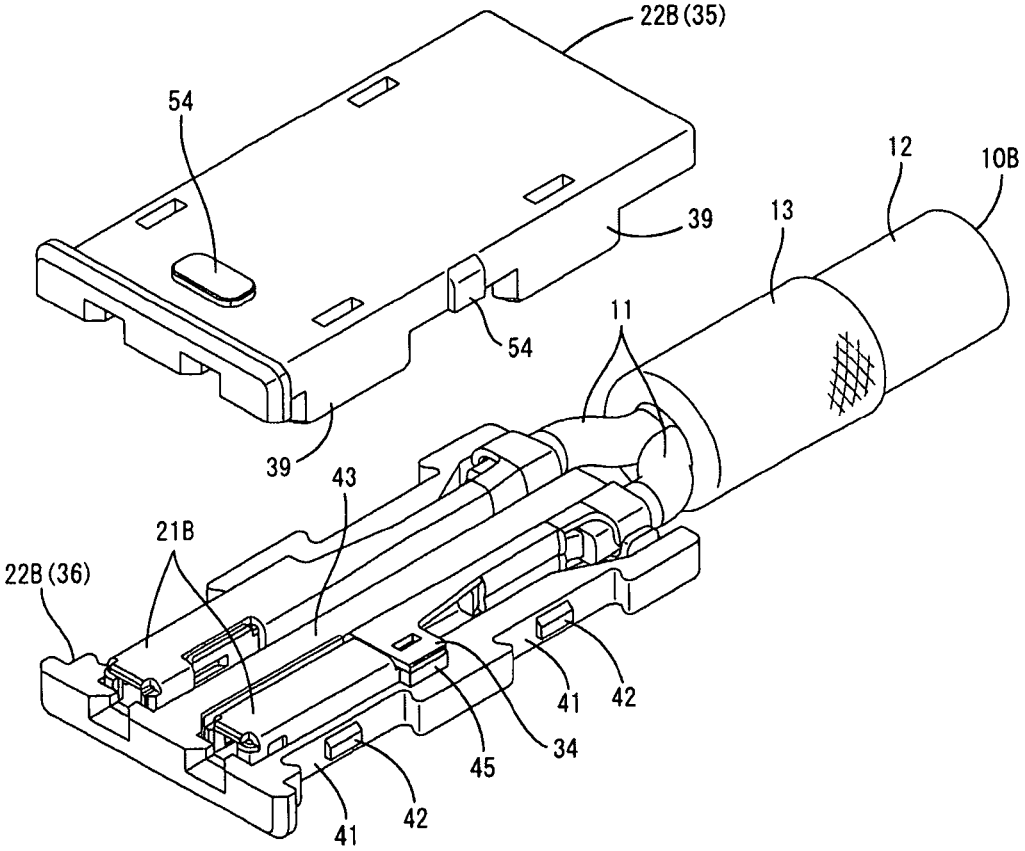
FIG. 15 is an exploded perspective view showing the lower dielectric in which the STP connection terminals are accommodated and an upper dielectric.

The STP dielectric 22B is made of a synthetic resin and is constituted of an upper dielectric 35 and a lower dielectric 36 that can be split vertically. As shown in FIG. 15, the upper dielectric 35 has a substantially rectangular plate shape in a plan view and has positioning protruding portions 54 on the upper surface and both side surfaces thereof for the outer conductor 24B. Both widthwise end portions of the upper dielectric 35 are provided with attachment pieces 39 similarly to the upper dielectric 35 of the UTP dielectric 22A. Also, similarly to the lower dielectric 36 of the UTP dielectric 22A, the lower dielectric 36 is provided with the attachment receiving portions 41 and the attachment protrusions 42, and by engagement between the attachment pieces 39 and the attachment protrusions 42, the lower dielectric 36 and the upper dielectric 35 are held in a combined state while the STP connection terminals 21B are sandwiched therebetween.

The STP connector 20B is not provided with the swaging ring 29, and a rear portion of each of the upper dielectric 35 and the lower dielectric 36 does not have a portion which receives the swaging ring 29 (corresponding to the recess 38 and the recessed portion 46). Accordingly, the front-rear dimensions of the upper dielectric 35 and the lower dielectric 36 of the STP dielectric 22B are shorter than those of the UTP dielectric 22A.

Figure 16:
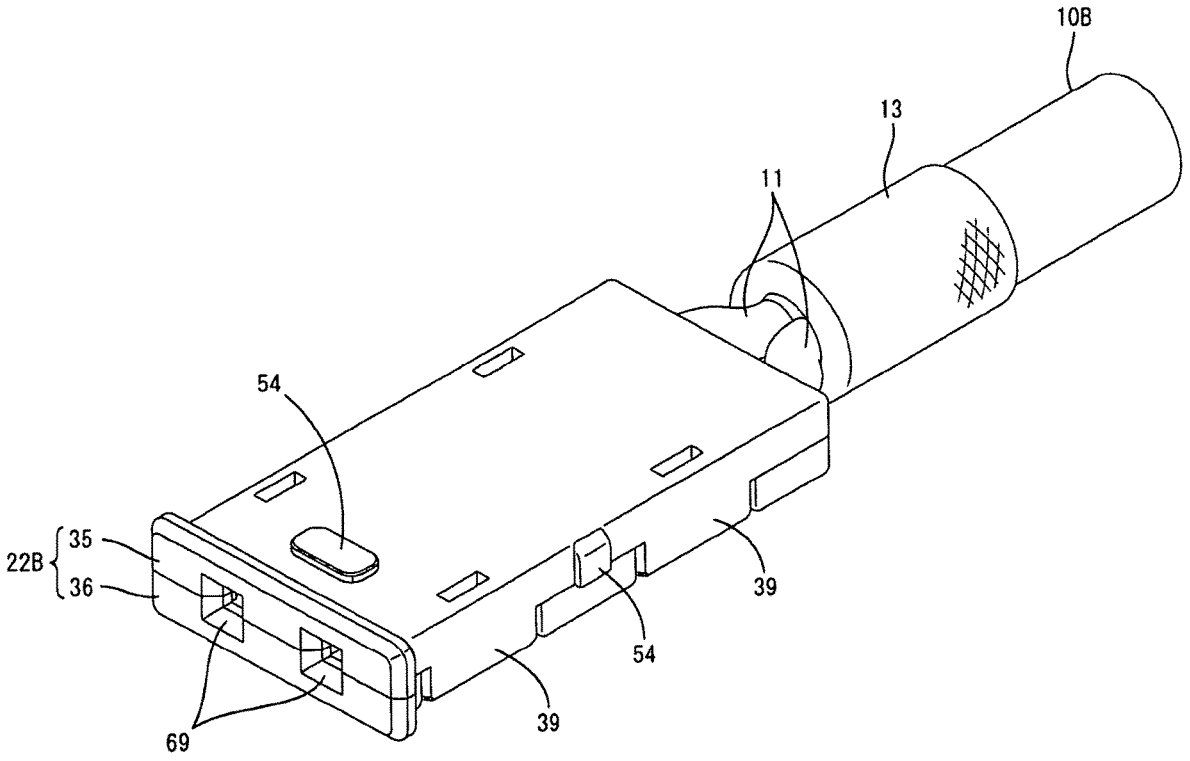
FIG. 16 is a perspective view of a STP dielectric in which the lower dielectric and the upper dielectric are held in a combined state.

As shown in FIG. 14, the upper surface of the lower dielectric 36 is provided with the accommodating portions 26 which position and hold the lower portions of the STP connection terminals 21B in a parallel state. The accommodating portions 26 each have a cross-sectional shape corresponding to the outer shape of the STP connection terminal 21B, and are provided in pairs on both sides in the width direction with the partition wall 43 sandwiched therebetween so as to correspond to the STP connection terminals 21B. As shown in FIG. 16, when the lower dielectric 36 and the upper dielectric 35 are in a combined state, tab insertion holes 69 through which the tab portions 92 can be inserted in communication with the accommodating portion 26 are provided as openings on a front surface of the STP dielectric 22B.

The thickness (dimension in the width direction) of the partition wall 43 of the STP dielectric 22B is slightly larger than the thickness of the partition wall 43 of the UTP dielectric 22A. Accordingly, the pitch width between the accommodating portions 26 of the STP dielectric 22B is larger than the pitch width between the accommodating portions 26 of the UTP dielectric 22A.

One of the accommodating portions 26 (upper side in FIG. 14) has a recess 44 formed by recessing the inner surface of the outer side wall facing the partition wall 43 in a cross-sectionally rectangular shape, and the other accommodating portion 26 (lower side in FIG. 14) has a plate piece-like protruding piece portion 45 protruding upward from a side edge of the outer side wall. The partition wall 43 has the step portion 52 having a stepped shape at a position adjacent to the recess 44 and the protruding piece portion 45.

Figure 24:
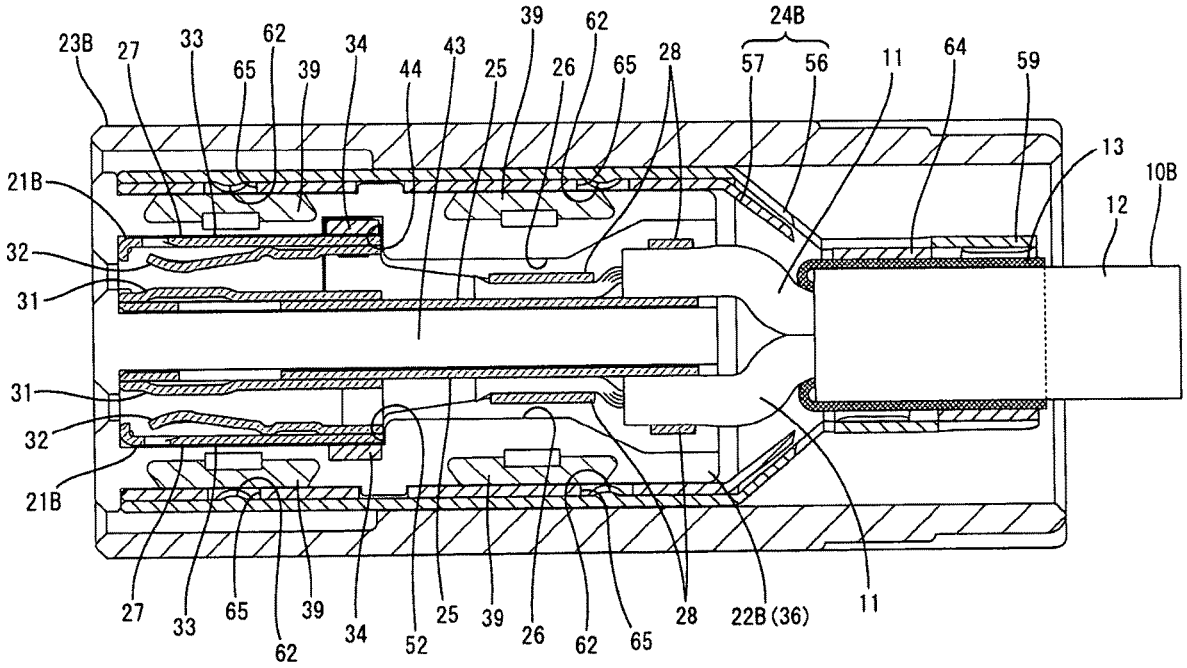
FIG. 24 is a cross-sectional view of the STP connector in a plan view direction.

As shown in FIG. 24, each STP connection terminal 21B is disposed such that the base plate portion 25 is disposed along an inner surface of the partition wall 43 and a rear end of the box portion 27 on the top plate portion 33 side is disposed along the step portion 52, so that the STP connection terminals 21B are disposed in a back-to-back fashion. The protruding portion 34 of the STP connection terminal 21B accommodated in one of the accommodating portions 26 is inserted into the recess 44, and the protruding portion 34 of the STP connection terminal 21B accommodated in the other accommodating portion 26 is placed and supported on the protruding piece portion 45.

[Outer Conductor]

Figure 19:
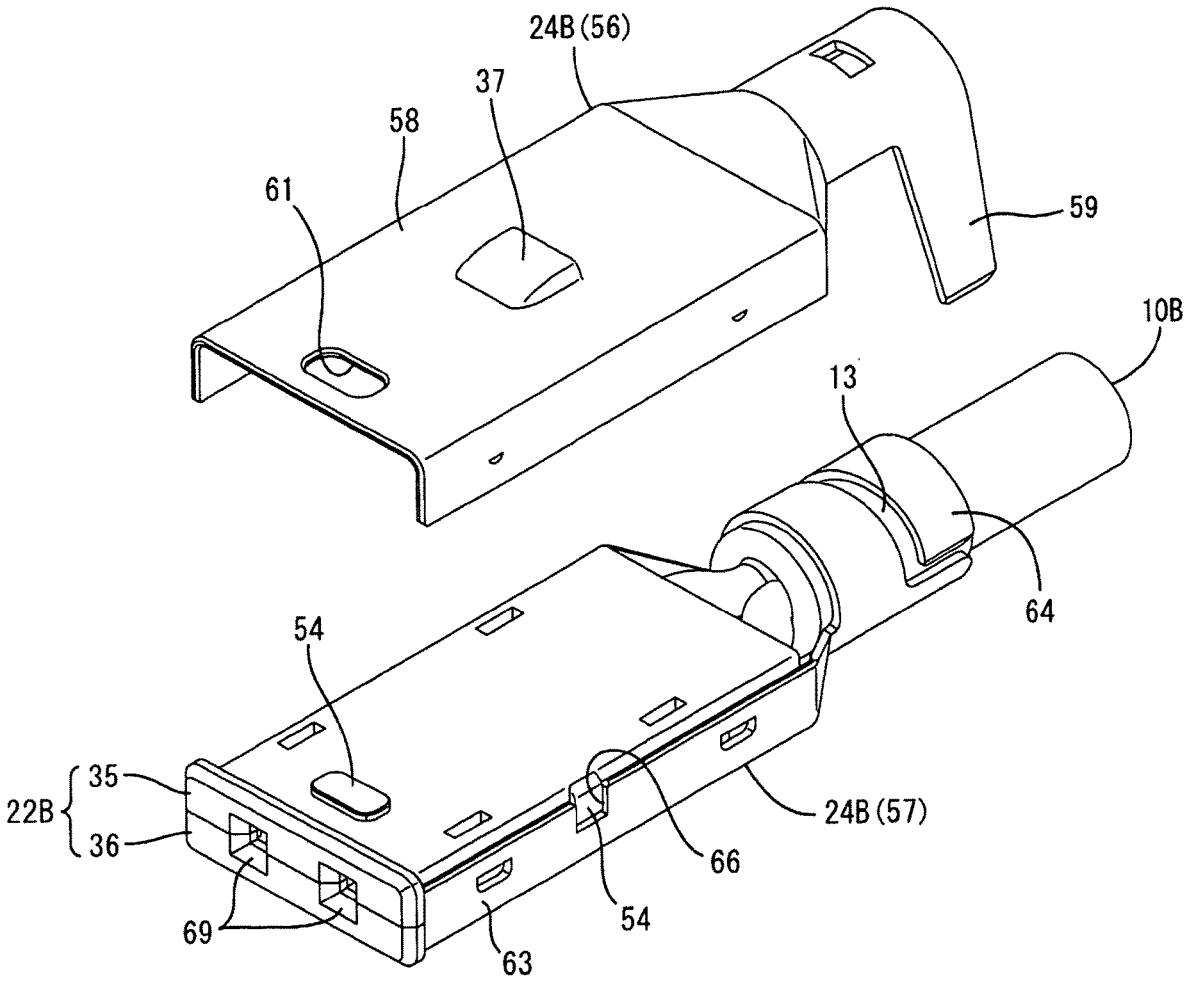
FIG. 19 is an exploded perspective view showing the lower outer conductor supporting the STP dielectric and an upper outer conductor.

The outer conductor 24B is made of a conductive metal and is constituted of an upper outer conductor 56 and a lower outer conductor 57 that can be split vertically. As shown in FIG. 19, the upper outer conductor 56 has an upper shell portion 58 having a substantially rectangular shape in a plan view and an open barrel-shaped upper barrel portion 59 continuing to a rear portion of the upper shell portion 58. The upper shell portion 58 is disposed so as to cover the upper dielectric 35 from above. A flat plate portion of the upper shell portion 58 has the locking protrusion 37 at a widthwise central portion of the upper surface and has an upper positioning hole 61 in front of the locking protrusion 37. The upper shell portion 58 has side plate portions hanging from both widthwise ends of the flat plate portion and has a pair of front and rear holding protrusions 62 on inner surfaces of the side plate portions as shown in FIG. 24. The upper barrel portion 59 has protruding piece portions which protrude downward from both widthwise side edges thereof while being displaced from each other in the front-rear direction.

Figure 17:
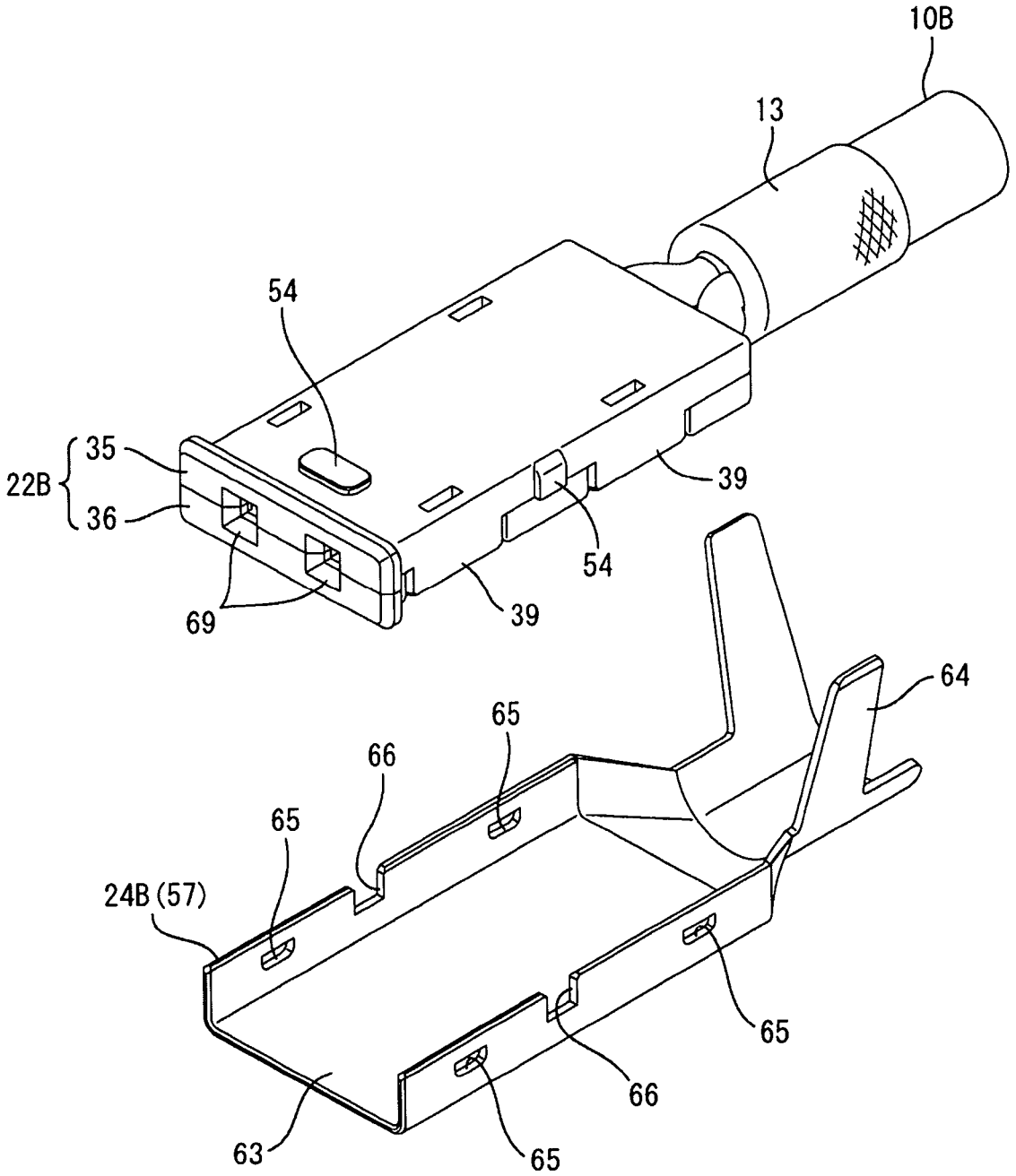
FIG. 17 is an exploded perspective view showing the STP dielectric and a lower outer conductor.

As shown in FIG. 17, the lower outer conductor 57 has a lower shell portion 63 having a substantially rectangular shape in a plan view and an open barrel-shaped lower barrel portion 64 continuing to a rear portion of the lower shell portion 63. The lower shell portion 63 is disposed so as to cover the lower dielectric 36 from below. The lower shell portion 63 has side plate portions standing from both widthwise ends of a flat plate portion and has a pair of front and rear holding holes 65 in the side plate portions. The central portion in the front-rear direction of each side plate portion of the lower shell portion 63 is provided with a lower positioning hole 66 opened to the upper end. The lower barrel portion 64 has protruding piece portions which protrude upward from both widthwise end edges while being displaced from each other in the front-rear direction.

When the upper outer conductor 56 and the lower outer conductor 57 enclose the STP dielectric 22B and are combined together, the side plate portions of the upper shell portion 58 cover the side plate portions of the lower shell portion 63 from the outside, and the holding protrusions 62 are inserted and locked in the holding holes 65 (see FIG. 24).

[STP Housing]

Figure 21:
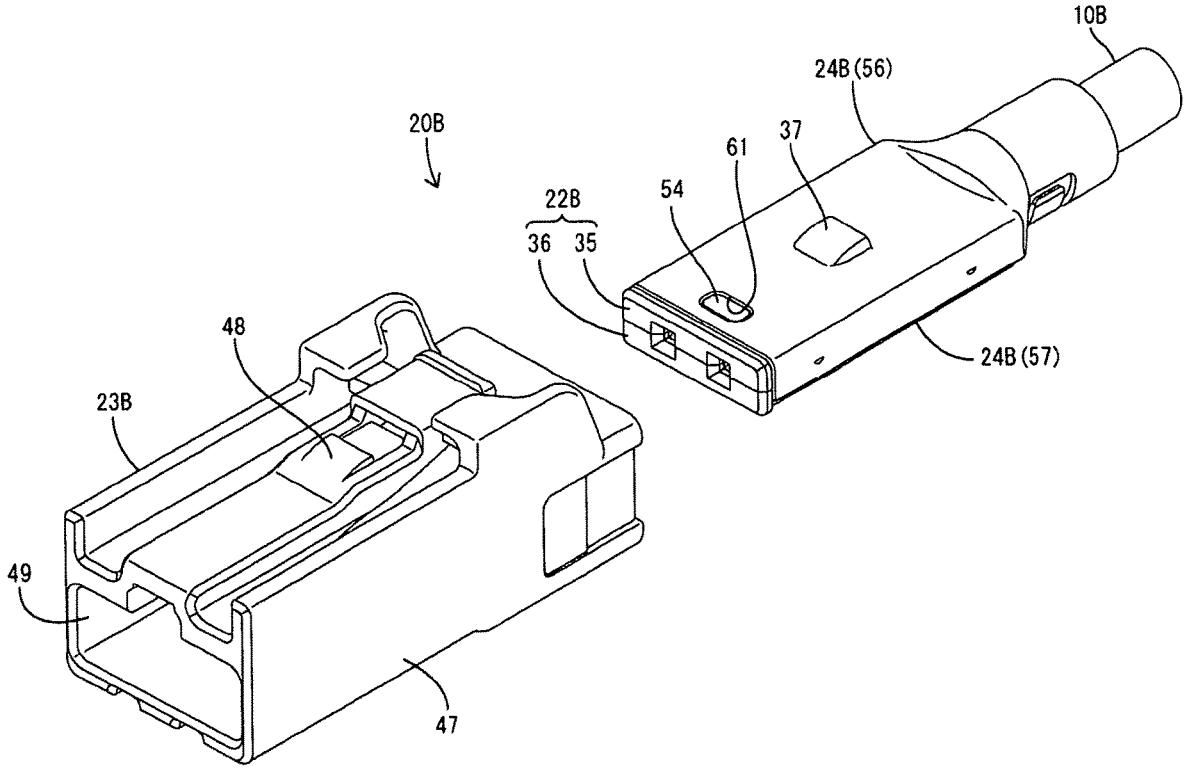
FIG. 21 is an exploded perspective view showing the outer conductor enclosing the STP dielectric, and an STP housing.
Figure 23:
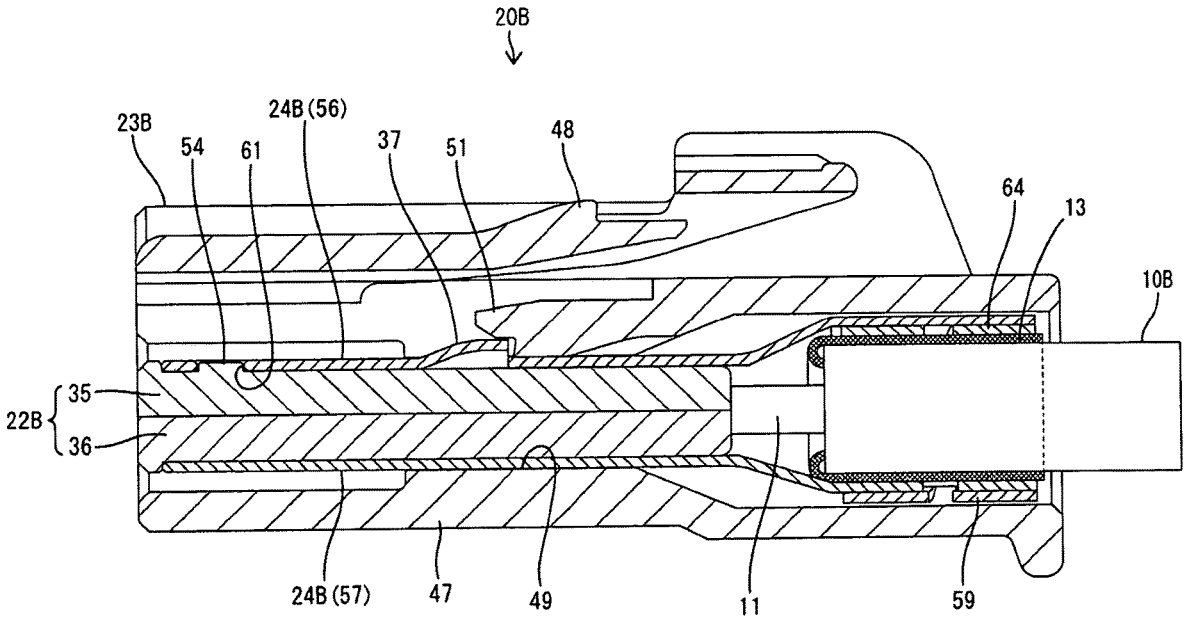
FIG. 23 is a cross-sectional view of the STP connector in a side view direction.

The STP housing 23B is made of a synthetic resin and, as shown in FIG. 21, has a substantially rectangular tubular housing body 47. The STP housing 23B has substantially the same shape as the UTP housing 23A, and has the lock arm 48, the insertion portion 49, and the lance 51. However, as shown in FIG. 23, the engagement partner of the lance 51 is the locking protrusion 37 of the upper outer conductor 56.

[Mating STP Connector]

Figure 27:
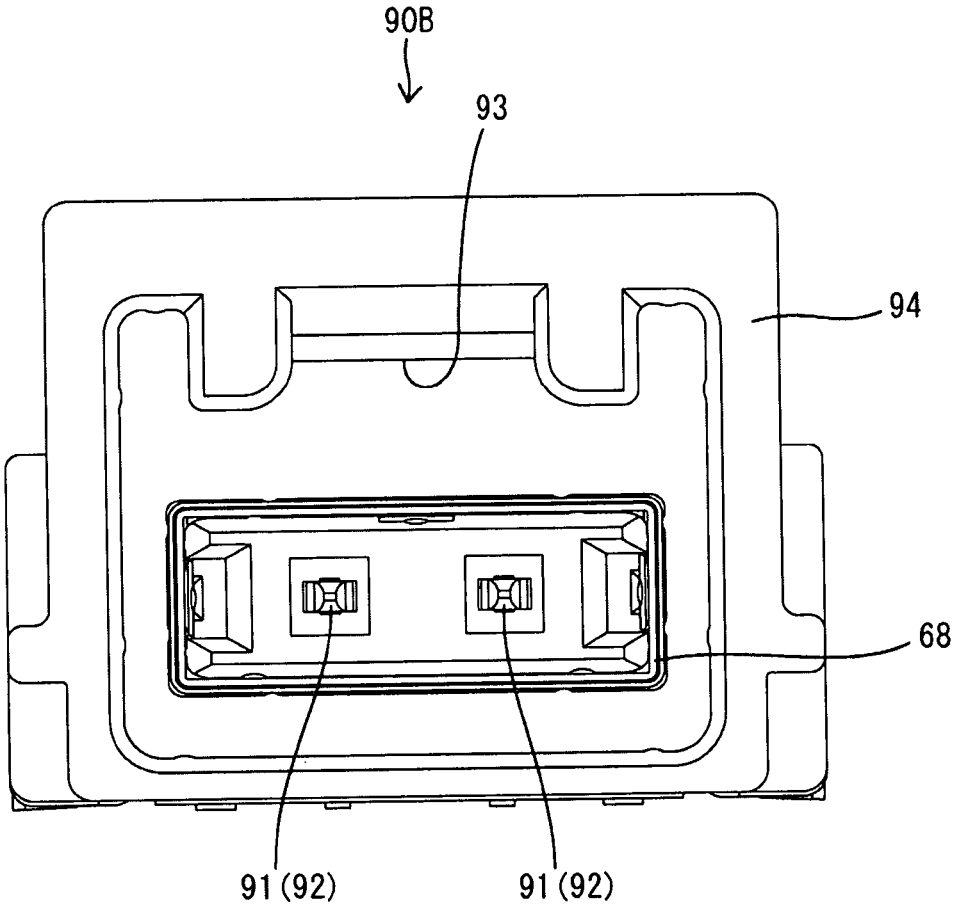
FIG. 27 is a front view of the mating STP connector.

As shown in FIG. 27, the mating STP connector 90B has a hood portion 94 made of a synthetic resin. The mating STP connector 90B has a configuration similar to that of the mating UTP connector 90A and has the hood portion 94, the lock receiving portion 93, the pegs 95, and the pair of male terminals 91. The pitch width between the male terminals 91 of the mating STP connector 90B is the same as the pitch width between the male terminals 91 of the mating UTP connector 90A.

[Assembly of UTP Connector]

Figure 3:
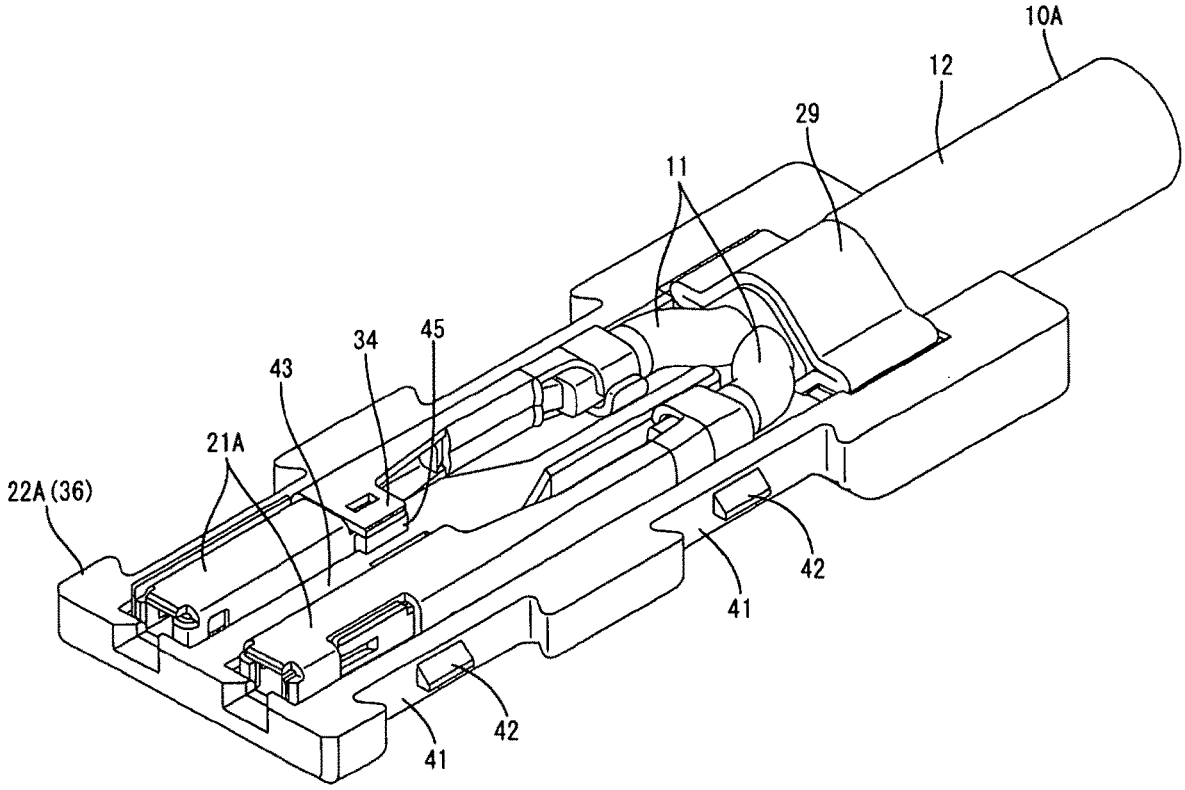
FIG. 3 is a perspective view showing a state in which the UTP connection terminals are accommodated in accommodating portions of the lower dielectric.

Upon assembling the UTP connector 20A, the barrel portion 28 of each UTP connection terminal 21A is first connected to the end portion of each electric wire 11 of the UTP cable 10A by crimping. Subsequently, each of the UTP connection terminals 21A is positioned and inserted into the accommodating portion 26 of the lower dielectric 36 from above, and, at the same time, the swaging ring 29 fitted to the UTP cable 10A is positioned and inserted into the recessed portion 46 of the lower dielectric 36 (see FIGS. 2 and 3). At this time, the UTP connection terminal 21A accommodated in one of the accommodating portions 26 is inserted with the protruding portion 34 facing upward, and the UTP connection terminal 21A accommodated in the other accommodating portion 26 is inserted with the protruding portion 34 facing downward. The upper dielectric 35 is then covered on the lower dielectric 36 from above, and the attachment pieces 39 elastically lock the attachment protrusions 42, whereby the upper dielectric 35 and the lower dielectric 36 are held in a combined state (see FIGS. 4 and 5).

Figure 7:
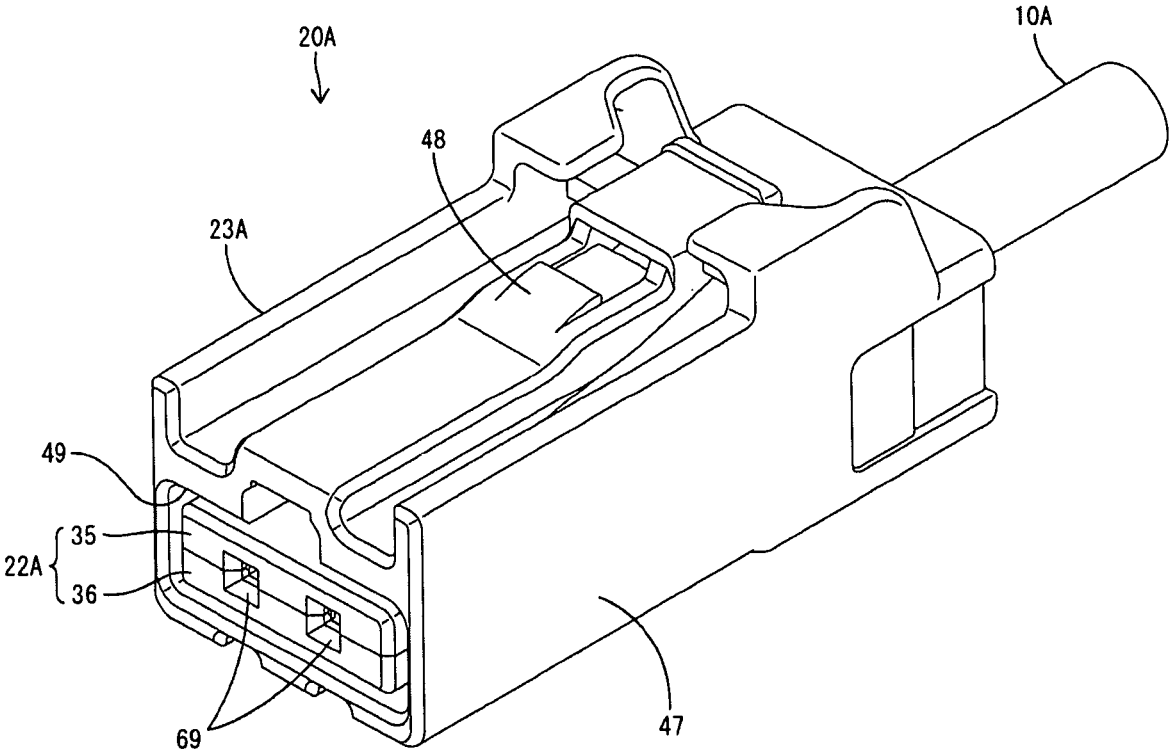
FIG. 7 is a perspective view of the UTP connector.

Subsequently, the UTP dielectric 22A is inserted into the insertion portion 49 of the UTP housing 23A from behind (see FIGS. 6 and 7). When the UTP dielectric 22A is properly inserted into the insertion portion 49, the lance 51 elastically locks the locking protrusion 37 of the UTP dielectric 22A, so that the UTP dielectric 22A is held in the UTP housing 23A in a retained state (see FIG. 8).

[Assembly of STP Connector]

Figure 26:
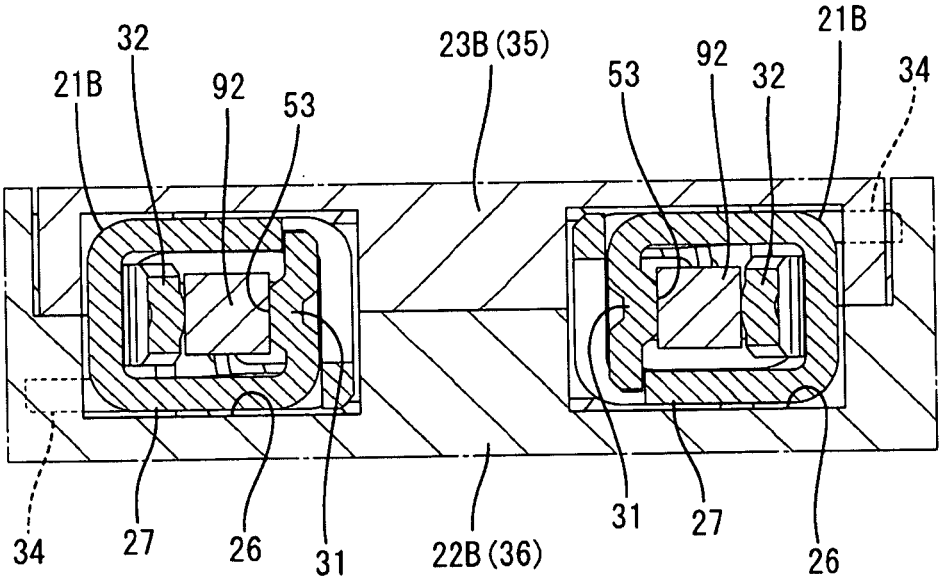
FIG. 26 is a front cross-sectional view showing the STP connection terminals and male terminals in a connected state.

Upon assembling the STP connector 20B, too, the barrel portion 28 of each STP connection terminal 21B is first connected to the end portion of each electric wire 11 of the STP cable 10B by crimping. Subsequently, each of the STP connection terminals 21B is positioned and inserted into the accommodating portion 26 of the lower dielectric 36 from above (see FIGS. 14 and 15). At this time, the STP connection terminal 21B accommodated in one of the accommodating portions 26 is inserted with the protruding portion 34 facing downward, and the STP connection terminal 21B accommodated in the other accommodating portion 26 is inserted with the protruding portion 34 facing upward. The upper dielectric 35 is then covered on the lower dielectric 36 from above, and by engagement between the attachment pieces 39 and the attachment protrusions 42, the upper dielectric 35 and the lower dielectric 36 are held in a combined state (see FIGS. 15 and 16). Here, the pitch width between widthwise inner ends of the STP connection terminals 21B in the STP dielectric 22B is larger than the pitch width between widthwise inner ends of the UTP connection terminals 21A in the UTP dielectric 22A due to the larger thickness of the partition wall 43 (see FIGS. 11 and 26).

Figure 18:
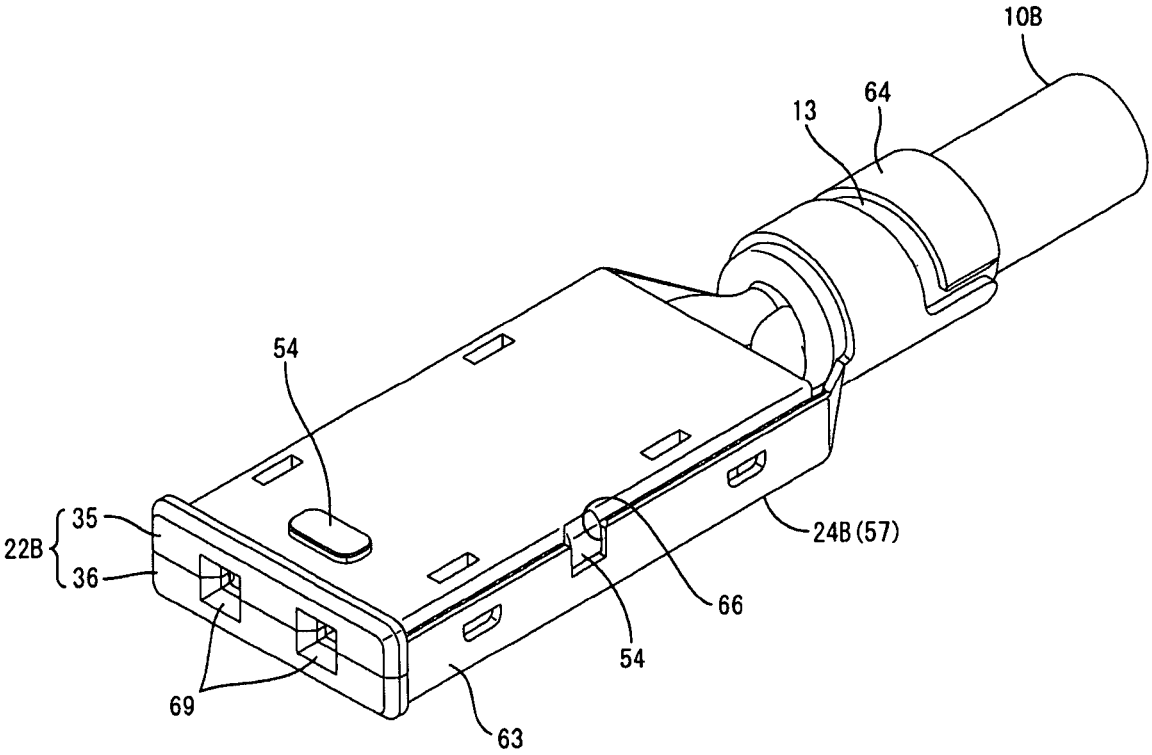
FIG. 18 is a perspective view showing a state in which the STP dielectric is supported by the lower outer conductor.

Subsequently, the STP dielectric 22B is supported by the lower shell portion 63 of the lower outer conductor 57 (see FIGS. 17 and 18). The positioning protruding portions 54 provided on both side surfaces of the upper dielectric are fitted to the lower positioning holes 66 of the lower shell portion 63, whereby the lower outer conductor 57 is positioned with respect to the STP dielectric 22B. At this time, the lower barrel portion 64 is disposed to face the shield conductor 13 exposed on the outer peripheral side of the STP cable 10B, from below. In this state, the lower barrel portion 64 is connected to the shield conductor 13 of the STP cable 10B by crimping.

Figure 20:
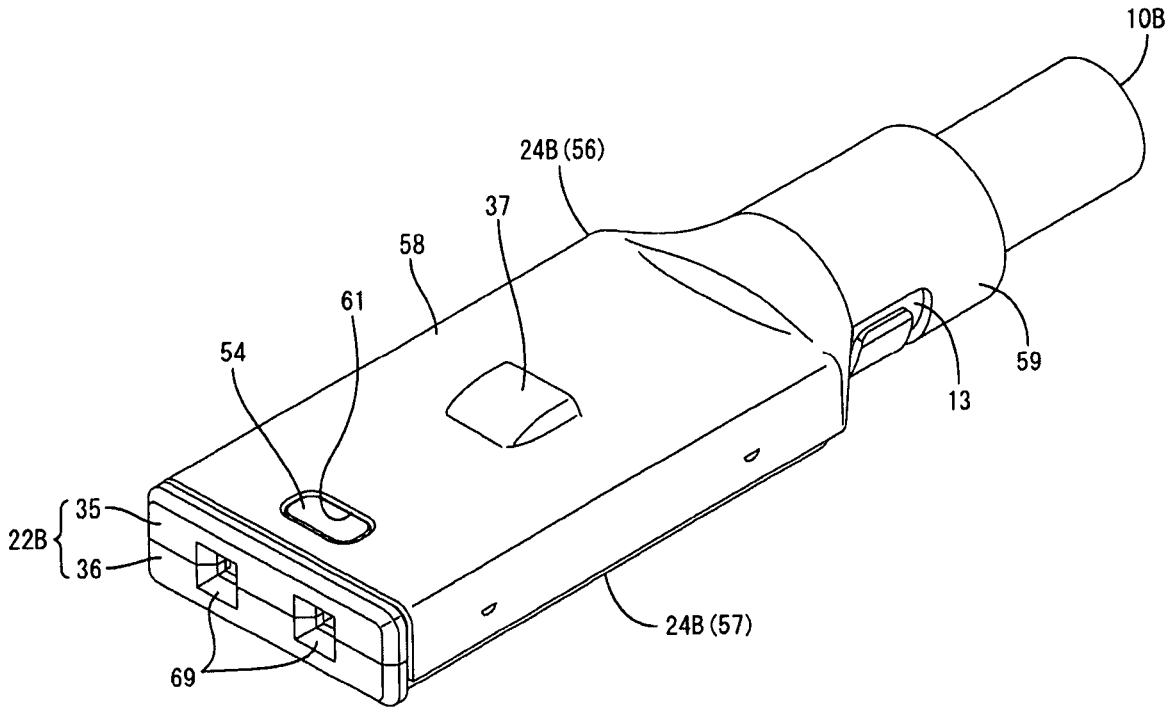
FIG. 20 is a perspective view of an outer conductor in which the lower outer conductor and the upper outer conductor are held in a combined state and which is connected to a shield conductor of an STP cable.

Next, the upper outer conductor 56 is covered on the lower outer conductor 57 so as to cover the STP dielectric 22B from above (see FIGS. 19 and 20). At this time, the upper outer conductor 56 and the lower outer conductor 57 are integrally held by engagement between the holding protrusions 62 and the holding holes 65. The positioning protruding portion 54 provided on an upper surface of the upper dielectric 35 is fitted to the upper positioning hole 61 of the upper shell portion 58, whereby the upper outer conductor 56 is positioned with respect to the STP dielectric 22B. Then, the upper barrel portion 59 is disposed to face the shield conductor 13 of the STP cable 10B from above. In this state, the upper barrel portion 59 is connected to the shield conductor 13 of the STP cable 10B by crimping. As a result, the shield conductor 13 is connected to the outer conductor 24B, and the periphery of the STP connection terminals 21B is surrounded by the outer conductor 24B via the STP dielectric 22B.

Figure 22:
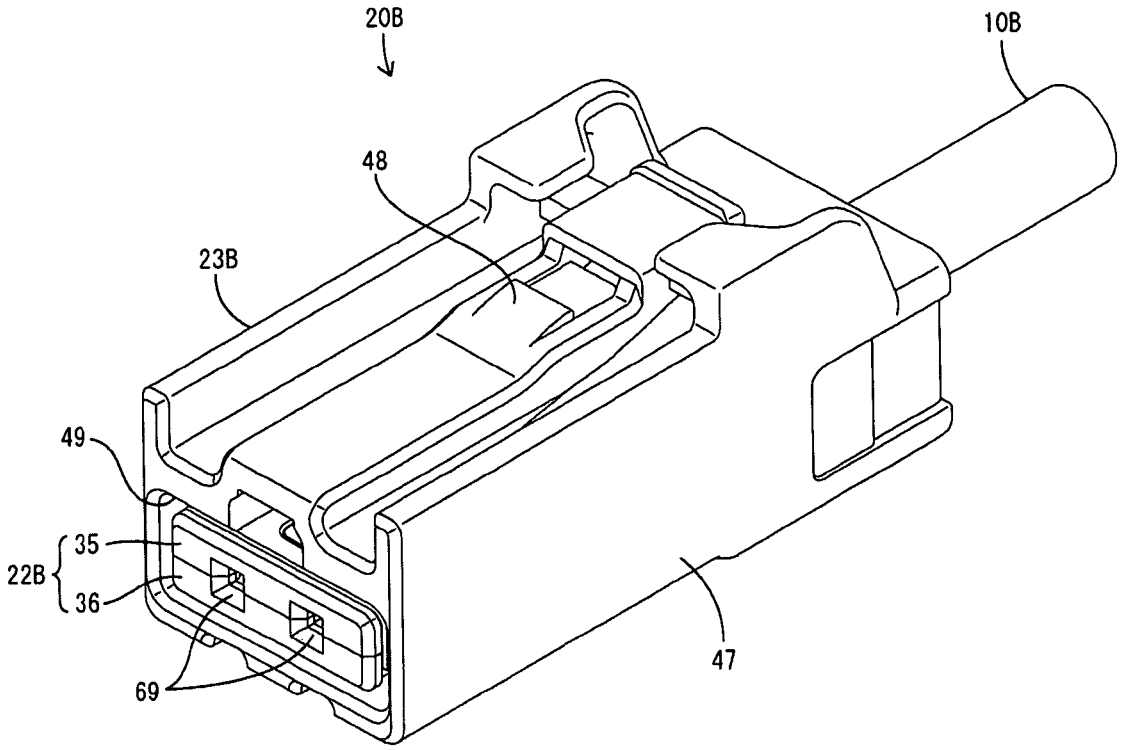
FIG. 22 is a perspective view of the STP connector.

Thereafter, the outer conductor 24B which encloses the STP dielectric 22B and is in the combined state is inserted into the insertion portion 49 of the STP housing 23B from behind (see FIGS. 21 and 22). When the outer conductor 24B is properly inserted into the insertion portion 49, the lance 51 elastically locks the locking protrusion 37 of the outer conductor 24B, so that the outer conductor 24B is held in the STP housing 23B in a retained state (see FIG. 23).

[Connector Fitting]

When the UTP connector 20A is properly fitted to the mating UTP connector 90A, the lock arm 48 elastically locks the lock receiving portion 93, so that both connectors are held in a separation restricted state. At this time, the tab portion 92 of each of the male terminals 91 is inserted and connected to the box portion 27 of each of the UTP connection terminals 21A (see FIG. 10).

Figure 25:
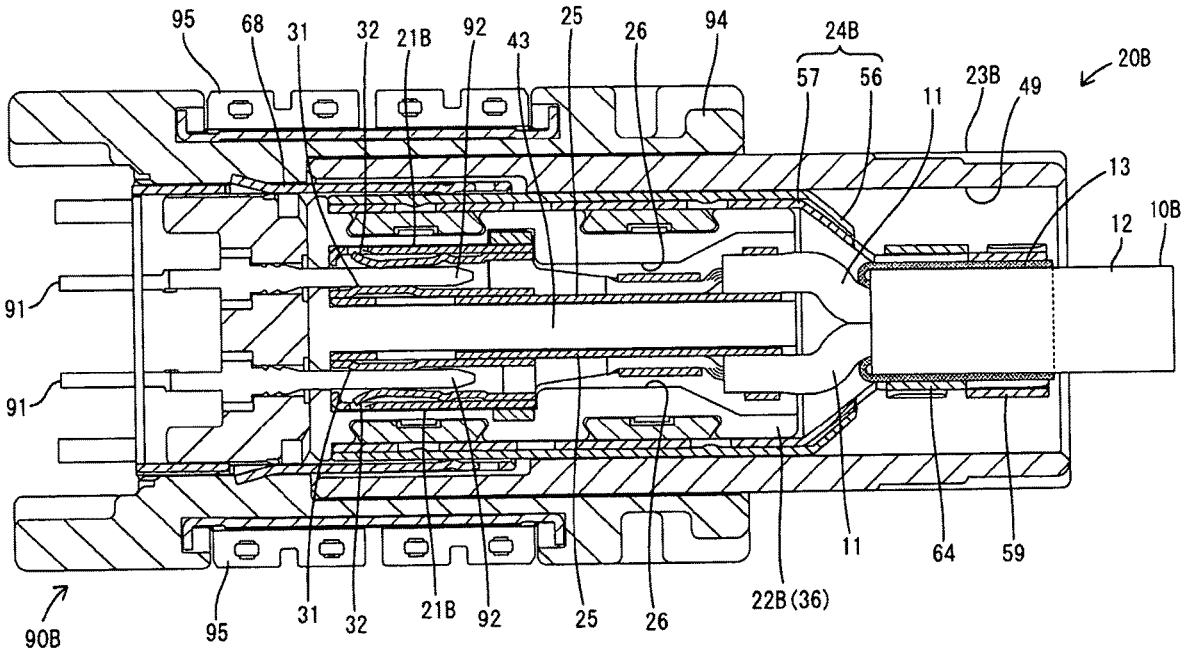
FIG. 25 is a planar cross-sectional view showing the STP connector and a mating STP connector in a fitted state.

Similarly, when the STP connector 20B is properly fitted to the mating STP connector 90B, the lock arm 48 elastically locks the lock receiving portion 93, so that both connectors are held in a separation restricted state, and the tab portion 92 of each of the male terminals 91 is inserted and connected to the box portion 27 of each of the STP connection terminals 21B (see FIG. 25). Furthermore, the outer conductor 24B is connected to a grounding plate 68 installed in the hood portion 94.

[Operation]

In the illustrated embodiment, the pitch width of the pair of accommodating portions 26 of the UTP dielectric 22A is smaller than the pitch width of the pair of accommodating portions 26 of the STP dielectric 22B, and a distance between opposing surfaces of the box portions 27 of the UTP connection terminals 21A accommodated in the pair of accommodating portions 26 of the UTP dielectric 22A is shorter than a distance between opposing surfaces of the box portions 27 of the STP connection terminals 21B accommodated in the pair of accommodating portions 26 of the STP dielectric 22B. Accordingly, the impedance on the UTP cable 10A side can be reduced, and the impedance on the STP cable 10B side can be increased, so that the impedance can be appropriately adjusted between the UTP cable 10A side and the STP cable 10B side. As a result, a specification change between the UTP connector 20A and the STP connector 20B can be easily performed.

Furthermore, the UTP connection terminals 21A are disposed in the accommodating portions 26 of the UTP dielectric 22A in a belly-to-belly fashion such that the respective elastic contact pieces 32 are disposed inside in the width direction, and the STP connection terminals 21B are disposed in the accommodating portions 26 of the STP dielectric 22B in a back-to-back fashion such that the respective elastic contact pieces 32 are disposed outside, with the result that the insertion region 53 of the UTP connection terminal 21A is disposed to be eccentric to the outside in the width direction of the accommodating portion 26, and the insertion region 53 of the STP connection terminal 21B is disposed to be eccentric to the inside in the width direction of the accommodating portion 26. The amount of eccentricity by which the insertion region 53 of the UTP connection terminal 21A is eccentric to the outside in the width direction is equal to the amount of eccentricity by which the insertion region 53 of the STP dielectric 22B is eccentric to the inside in the width direction, and is substantially equal to a value obtained by subtracting the pitch width of the pair of accommodating portions 26 of the UTP dielectric 22A from the pitch width of the pair of accommodating portions 26 of the STP dielectric 22B.

Thus, a difference in the pitch width between the accommodating portions 26 is canceled only by changing the positional relationship between the elastic contact piece 32 and the receiving portion 31 between the UTP connection terminal 21A and the STP connection terminal 21B, with the result that the pitch width between the tab portions 92 of the male terminals 91 can be identical to the same pitch width between the mating UTP connector 90A and the mating STP connector 90B, and the mating UTP connector 90A and the mating STP connector 90B can be constructed in a similar structure. In the mating UTP connector 90A and the mating STP connector 90B, specifically, the hood portion 94 is constituted of a cylindrical portion on the outside to which the pegs 95 are attached and an inner wall portion on the inside to which the male terminals 91 are attached. Among these portions, since the cylindrical portion on the outside has a common structure between the mating UTP connector 90A and the mating STP connector 90B, it is possible to correspond to the respective specifications of the mating UTP connector 90A and the mating STP connector 90B by replacing the inner wall portion. As a result, it is possible to realize a connector structure excellent in versatility as a whole.

Furthermore, the box portions 27 of the UTP connection terminal 21A and the STP connection terminal 21B have the same shape, the UTP housing 23A and the STP housing 23B have a similar shape, and, in addition, the UTP dielectric 22A and the STP dielectric 22B are also similar to each other, with the result that it is possible to replace the STP cable 10B and the UTP cable 10A without making a large structural change as a whole, and the cost can be reduced.

OTHER EMBODIMENTS

Other embodiments will be briefly described.

(1) In the illustrated embodiment, both of the UTP dielectric and the STP dielectric can be split vertically; however, according to the present invention, at least one of the UTP dielectric and the STP dielectric may be integrally provided in an unsplittable fashion.

(2) In the illustrated embodiment, the outer conductor of the STP connector can be split vertically. However, according to the present invention, the outer conductor may be integrally provided in an unsplittable fashion.

(3) Two or more protrusions may be provided in the box portion. The protruding direction of the protrusion is arbitrary.

(4) The UTP connection terminal and the STP connection terminal may not have perfectly the same structure and may have shapes different from each other in an allowable range, for example, in the shape of the barrel portion.

REFERENCE SIGNS LIST

10A UTP cable
10B STP cable
11 electrical wire
20A UTP connector
20B STP connector
21A UTP connection terminal
21B STP connection terminal
22A UTP dielectric
22B STP dielectric
24B outer conductor
26 accommodating portion
27 box portion
31 receiving portion
32 elastic contact piece
34 protruding portion
43 partition wall
44 recess
45 protruding piece portion
90A mating UTP connector
90B mating STP connector
91 male terminal
92 tab portion

The invention claimed is:

1. A connector structure comprising:

a UTP (unshielded twisted pair) connection terminal which is connected to each electric wire of a UTP cable and has a box portion to which a male terminal is inserted and connected;

an STP (shielded twisted pair) connection terminal which is connected to each electric wire of an STP cable and has a box portion to which a male terminal is inserted and connected;

a UTP dielectric which has an accommodating portion in which the UTP connection terminal is accommodated; and an STP dielectric which has an accommodating portion in which the STP connection terminal is accommodated, wherein a receiving portion and an elastic contact piece facing the receiving portion are arranged in each of the box portions of the UTP connection terminal and the STP connection terminal, the elastic contact piece protrudes inside the box portion with a protruding amount larger than that of the receiving portion, the male terminal is held between the receiving portion and the elastic contact piece, in each of the UTP dielectric and the STP dielectric, the accommodating portions are arranged in pairs in a width direction perpendicular to an insertion direction of the male terminal, a widthwise clearance of the pair of accommodating portions is shorter in the UTP dielectric than in the STP dielectric, the UTP connection terminals are accommodated in the pair of accommodating portions of the UTP dielectric such that the elastic contact pieces thereof are located on inner sides of the accommodating portions of the UTP dielectric in the width direction so as to be close to each other in the width direction and the receiving portions thereof are located on outer sides of the accommodating portions of the UTP dielectric in the width direction so as to be spaced apart from each other in the width direction, and the STP connection terminals are accommodated in the pair of accommodating portions of the STP dielectric such that the elastic contact pieces thereof are located on outer sides of the accommodating portions of the STP dielectric in the width direction so to be spaced apart from each other in the width direction and the receiving portions thereof are located on inner sides of the accommodating portions of the STP dielectric in the width direction so as to be close to each other in the width direction, wherein the box portion of the UTP connection terminal has the same shape as the box portion of the STP connection terminal.

* * * * *